US011283219B2

(12) United States Patent
Amini et al.

(10) Patent No.: US 11,283,219 B2
(45) Date of Patent: Mar. 22, 2022

(54) CONNECTORS WITH HIGH RETENTION FORCE

(71) Applicant: Apple Inc., Cupertino, CA (US)

(72) Inventors: Mahmoud R. Amini, Sunnyvale, CA (US); Rui Zhou, Sunnyvale, CA (US); Adam H. Herzog, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/537,975

(22) Filed: Aug. 12, 2019

(65) Prior Publication Data

US 2020/0099169 A1 Mar. 26, 2020

Related U.S. Application Data

(60) Provisional application No. 62/735,162, filed on Sep. 23, 2018.

(51) Int. Cl.

| | |
|---|---|
| ***H01R 13/627*** | (2006.01) |
| ***H01R 13/639*** | (2006.01) |
| *H01R 107/00* | (2006.01) |
| *H01R 24/60* | (2011.01) |

(52) U.S. Cl.

CPC ..... *H01R 13/639* (2013.01); *H01R 24/60* (2013.01); *H01R 2107/00* (2013.01)

(58) Field of Classification Search

CPC ..... H01R 13/62938; H01R 13/633; H01R 23/7005; H01R 13/6272; H01R 13/6275; H01R 13/658; H01R 13/639; H01R 24/60; H01R 2107/00; G06K 13/08; G06F 1/184

USPC ..... 439/157, 159, 160, 325, 327, 352, 357, 439/358, 607.47, 607.48, 928.1

See application file for complete search history.

(56) References Cited

U.S. PATENT DOCUMENTS

| | | | | |
|---|---|---|---|---|
| 5,383,794 A * | 1/1995 | Davis | H01R 13/516 | 439/352 |
| 5,741,150 A * | 4/1998 | Stinson | H01R 13/6275 | 439/157 |
| 5,860,826 A * | 1/1999 | Chang | H01R 13/6275 | 439/358 |
| 5,941,726 A * | 8/1999 | Koegel | H01R 13/6275 | 439/358 |
| 6,149,451 A * | 11/2000 | Weber | H01R 13/6275 | 439/358 |
| 6,210,202 B1 * | 4/2001 | Kuo | H01R 13/6275 | 439/358 |
| 6,371,789 B1 * | 4/2002 | Sato | H01R 13/6275 | 439/358 |
| 6,377,451 B1 * | 4/2002 | Furuya | G06F 1/1616 | 360/99.02 |
| 6,602,082 B2 * | 8/2003 | Nishide | H01R 13/62938 | 439/157 |

(Continued)

*Primary Examiner* — Thanh Tam T Le

(74) *Attorney, Agent, or Firm* — Kilpatrick Townsend & Stockton, LLP

(57) ABSTRACT

Mechanisms that may help to secure connector inserts in place when they are plugged into a connector receptacle on an electronic device. One example may provide a connector receptacle having a friction mechanism to provide friction between a connector insert and a connector receptacle when the connector insert is inserted in the connector receptacle. Other examples may provide a connector receptacle having a locking mechanism to hinder or prevent extraction of a connector insert.

19 Claims, 21 Drawing Sheets

(56) References Cited

U.S. PATENT DOCUMENTS

| | | | | |
|---|---|---|---|---|
| 6,648,665 | B1 * | 11/2003 | Wu | H01R 13/6275 439/352 |
| 7,121,854 | B2 * | 10/2006 | Buck | B25F 5/02 439/160 |
| 7,264,491 | B2 * | 9/2007 | McBroom | G06F 1/185 439/160 |
| 7,735,159 | B2 * | 6/2010 | Prendergast | F16M 13/00 2/422 |
| 7,959,451 | B2 * | 6/2011 | Tonosaki | H01R 13/62938 439/157 |
| 8,944,833 | B2 * | 2/2015 | Takahashi | H05K 5/0295 439/159 |
| 8,961,217 | B2 * | 2/2015 | Dang | H01R 13/58 439/358 |
| 9,431,772 | B2 | 8/2016 | Gao | |
| 9,843,133 | B2 | 12/2017 | Kashani | |
| 10,177,495 | B2 * | 1/2019 | Dupeux | H01R 43/26 |
| 10,374,362 | B2 * | 8/2019 | Degner | H01R 13/4536 |
| 10,559,914 | B2 * | 2/2020 | Goossens | H01R 13/639 |
| 10,566,728 | B1 * | 2/2020 | Sundarakrishnamachari | H01R 13/6278 |
| 10,622,760 | B2 * | 4/2020 | Tsukiyoshi | H01R 13/62955 |
| 10,707,614 | B2 * | 7/2020 | Tsukiyoshi | H01R 13/62938 |
| 11,011,872 | B2 * | 5/2021 | Fu | H01R 12/721 |

* cited by examiner

CONNECTORS WITH HIGH RETENTION FORCE

CROSS REFERENCES TO RELATED APPLICATIONS

This application claims the benefit of U.S. provisional application No. 62/735,162, filed on Sep. 23, 2018, which is incorporated by reference.

BACKGROUND

Power and data may be provided from one electronic device to another over cables that may include one or more wires, fiber optic cables, or other conductors. Connector inserts may be located at each end of these cables and may be inserted into connector receptacles in communicating or power transferring electronic devices.

Unfortunately, these connector inserts may inadvertently become detached or extracted from the connector receptacles. For example, a device in an electronic system may be moved, and a cable plugged into the device may become disconnected. In other situations, a cable plugged into the moved device may pull on a second cable connected to a second device. This may cause the second cable to become disconnected from the second device. Vibrations and other forces may also cause a disconnection over time.

Such inadvertent disconnections may not be immediately noticed. This may cause confusion on the part of a user who is using the electronic system. It may interrupt the charging of a device, leaving the disconnected electronic device with a discharged battery after a period of time. These disconnections may also interrupt ongoing processes, such as a data backup or complicated graphics rendering process, that are being performed by the electronic system. This may have unfortunate consequences, such as when a user may not notice that the processing has stopped or where such processing can't be easily restarted.

The connector receptacles may also be in an out-of-the way or difficult place to reach. An undesired connector insert extraction may be difficult to correct in such a situation. A user may have to crawl under a desk or move heavy furniture or equipment to plug the connector insert back into the connector receptacle.

Further, even when a connector insert is not extracted enough to be disconnected, it may move relative to the connector receptacle. That is, it may wiggle. Once this occurs, connections between individual contacts in the connectors may become intermittent or unreliable.

Thus, what is needed are mechanisms that may help to secure connector inserts in place when they are plugged into a connector receptacle on an electronic device.

SUMMARY

Accordingly, embodiments of the present invention may provide mechanisms that may help to secure connector inserts in place when they are plugged into a connector receptacle on an electronic device.

An illustrated embodiment of the present invention may provide a connector receptacle having a friction mechanism to provide friction between a connector insert and a connector receptacle when the connector insert is inserted in the connector receptacle. The friction mechanism may be located in the connector receptacle and may include a friction pad that physically contacts a shield or other portion of a connector insert when the connector insert and the connector receptacle are mated. The friction mechanism may further include an engagement mechanism. The engagement mechanism may increase a force applied by the friction pad against the connector insert shield when the engagement mechanism comes into contact with the connector insert shield. These and other embodiments of the present invention may provide one or more friction mechanisms in a connector receptacle. For example, a connector receptacle may include two friction mechanisms, one on each lateral side of a connector receptacle opening.

These and other embodiments of the present invention may provide a connector receptacle having two friction mechanisms, one on each side of a connector receptacle opening near lateral sides of a connector receptacle tongue. The friction mechanisms may include a friction pad. As a connector insert is inserted into the connector receptacle, a shield or other portion of the connector insert may come into contact with friction pads on the friction mechanisms on each lateral side of the connector receptacle. As the connector insert continues to be inserted, the connector insert shield may encounter engagement mechanism front sides on each of the friction mechanisms. This may cause the friction mechanism to rotate, slide, or otherwise move, thereby bringing the friction pads into more forceful contact with the connector insert shield. For example, the friction mechanism may rotate thereby pushing an engagement mechanism backside against a spring associated with the friction mechanism. The resulting increase in force by the friction pad against the connector insert shield may increase an insertion force needed by the user for the remainder of the connector insert insertion. However, as the connector insert is inserted, the shield pushes against the engagement mechanism front sides such that the engagement mechanism front sides rotate away from the connector insert shield. This prevents the increase in insertion force from being excessively large and thereby improves the user experience. As the connector insert is extracted, the connector insert shield pulls on the engagement mechanism front sides such that they rotate into the connector insert shield. This greatly increases the required extraction force needed to extract the connector insert from the connector insert. This may help to prevent side-to-side movement and accidental extraction of the connector insert while it is inserted in the connector receptacle. As the connector insert continues to be extracted, it may disengage from the engagement mechanisms on the friction mechanisms. The friction pads may continue to provide a reduced force preventing extraction as the connector insert is withdrawn from the connector receptacle. The spring associated with the friction mechanism may rotate the friction mechanism back in place.

These and other embodiments of the present invention may provide a connector receptacle having a locking mechanism to hinder or prevent extraction of a connector insert. These locking mechanisms may have a locked state and an unlocked state. The locking mechanisms may be manually toggled between locked and unlocked states using a switch, a slider, a touch switch, or other structure. The locking mechanisms may be electronically toggled between locked and unlocked states using electronic signals driving switches, relays, or other electronic, mechanical, or electromechanical components.

When the locking mechanism is in the unlocked state, a connector insert may be inserted into and extracted from the connector receptacle with a conventional or near convention force. When the locking mechanism is in the locked state, a connector insert may be inserted into the connector receptacle with a somewhat higher amount of force, though the increase in necessary force may not be noticeable. When the locking mechanism is in the locked state, a high amount of force may be necessary to extract the connector insert. The amount of force may be sufficiently high that the connector insert may appear to be locked in the connector receptacle.

In these and other embodiments of the present invention, a connector receptacle may include a locking mechanism may include a cam that may be in contact with a portion of a connector insert when the connector insert is inserted and extracted from the connector receptacle. A cam lock may be engaged with the cam when a switch is in a locked position and the cam lock may be disengaged from the cam when the switch is in an unlocked position. When the switch is in the unlocked state, the switch may push the cam lock away from the cam. The cam may then rotate freely when a connector insert is inserted into and extracted from the connector receptacle. When the switch is in the locked position, the cam lock may be in contact with the cam. The cam may rotate in a first direction when a connector insert is inserted into the connector receptacle. In this direction, the cam lock may provide a limited amount of force thereby allowing a user to insert a connector insert even while the connector receptacle is locked. When the switch is in the locked position, the cam may try to rotate in a second direction when a connector insert is extracted from the connector receptacle. This may cause the cam to bind with the cam lock, thereby preventing rotation of the cam in the second direction. The connector insert may thus appear to be locked in place in the connector receptacle.

These and other embodiments may provide a locking mechanism having a gear that includes a number teeth to engage a tooth on a gear lock when a switch or other mechanism is in the locked state. The gear teeth may be angled to allow the gear to rotate in a first direction when a connector insert is inserted and to lock in place against the gear lock tooth when a connector insert is extracted. This ratcheting may allow insertion of a connector insert while hindering or preventing its extraction.

While embodiments of the present invention may be useful as USB Type-C connector receptacles, these and other embodiments of the present invention may be used as connector receptacles in other types of connector systems.

In various embodiments of the present invention, contacts, ground pads, springs, shields, cams, cam locks, gear, gear locks, and other portions of a connector receptacle may be formed by stamping, metal-injection molding, machining, micro-machining, 3-D printing, or other manufacturing process. These portions may be formed of stainless steel, steel, copper, copper titanium, phosphor bronze, or other material or combination of materials. They may be plated or coated with nickel, gold, or other material. Other portions, such as housings, friction wheels, and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials.

Embodiments of the present invention may provide connector receptacles that may be located in, and may connect to, various types of devices, such as portable computing devices, tablet computers, desktop computers, laptops, all-in-one computers, wearable computing devices, smart phones, storage devices, portable media players, navigation systems, monitors, power supplies, video delivery systems, adapters, remote control devices, chargers, and other devices. These connector receptacles may provide interconnect pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector receptacles that may be used to provide a reduced set of functions for one or more of these standards. In various embodiments of the present invention, these interconnect paths provided by these connector receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
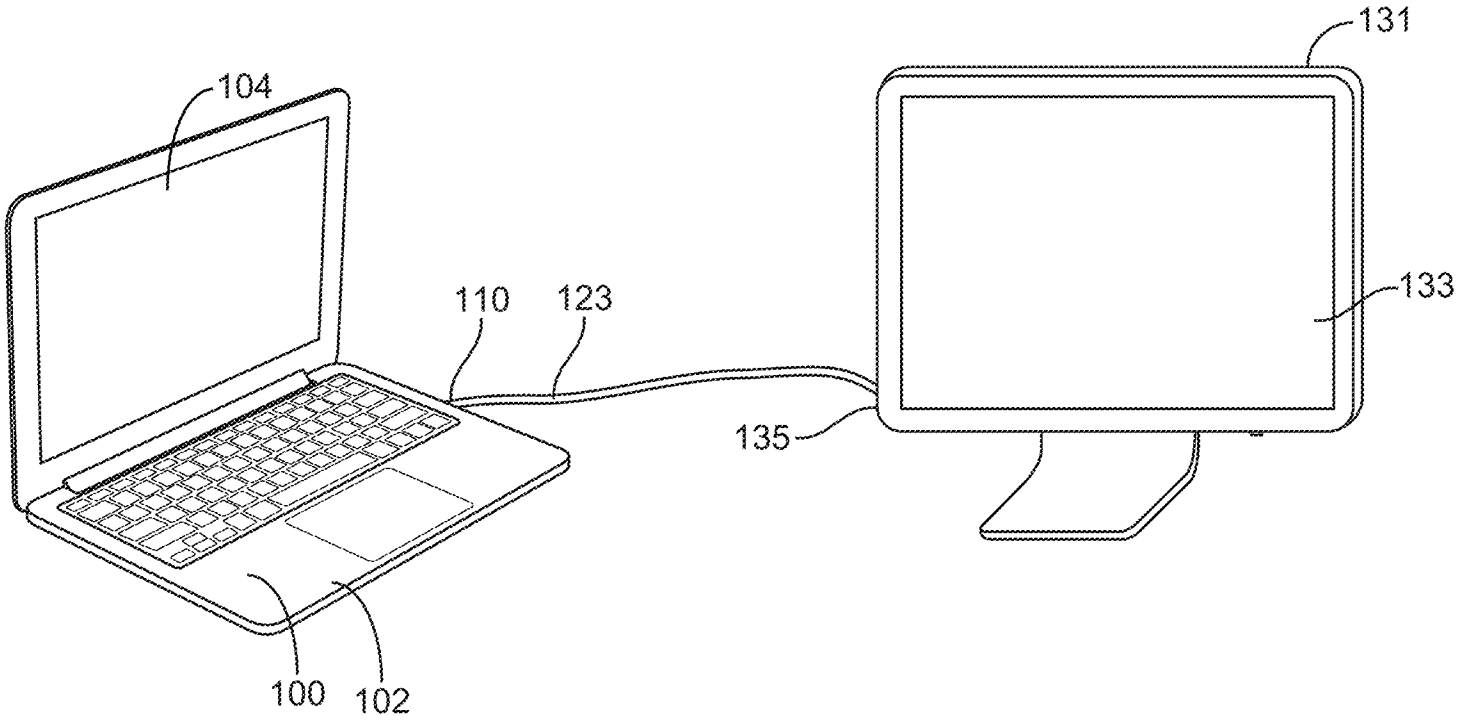
FIG. 1 illustrates an electronic system that may be improved by the incorporation of embodiments of the present invention.

FIG. 1 illustrates an electronic system that may be improved by the incorporation of an embodiment of the present invention. This figure, as with the other included figures, is shown for illustrative purposes and does not limit either the possible embodiments of the present invention or the claims.

This example illustrates monitor 131 that may be in communication with computer 100. Computer 100 may be substantially housed in device enclosure 102. Computer 100 may provide video or other data over cable 123 to monitor 131. Video data may be displayed on the video screen 133 of monitor 131. Computer 100 may similarly include a screen 104. In other embodiments the present invention, other types of devices may be included, and other types of data and power may be shared or transferred among the devices. For example, computer 100 and monitor 131 may be portable computing devices, tablet computers, desktop computers, laptops, all-in-one computers, wearable computing devices, smart phones, storage devices, portable media players, navigation systems, monitors, power supplies, video delivery systems, adapters, remote control devices, chargers, and other devices.

Cable 123 may be one or a number of various types of cables. For example, it may be a Universal Serial Bus (USB) cable such as a USB Type-C cable, Thunderbolt, DisplayPort, Lightning, or other type of cable. Cable 123 may include compatible connector inserts 210 (shown in FIG. 2) that plug into connector receptacle 110 on the computer 100 and connector receptacle 135 on monitor 131.

It may be desirable that connector inserts 210 on cable 123 are not inadvertently disconnected or extracted from connector receptacles 110 and 135. It may also be undesirable that these connector inserts 210 be able to move relative to the connector receptacles 110 and 135. That is, it may desirable if they are not able to wiggle. When connector inserts 210 are able to move relative to connector receptacles 110 and 135, connections between individual contacts in the connectors may become intermittent or unreliable.

An illustrated embodiment of the present invention may provide a connector receptacle having one or more friction mechanisms to provide friction between a connector insert and a connector receptacle when the connector insert is inserted in the connector receptacle. Two friction mechanisms may be located in opposite sides of the connector receptacle. They may each include a friction pad that physically contacts a shield on a connector insert when the connector insert and the connector receptacle are mated. The friction mechanisms may further include an engagement mechanism. The engagement mechanism may increase a force applied by the friction pad against the connector insert shield when the engagement mechanism comes into contact with the connector insert shield. Examples are shown in the following figures.

Figure 2:
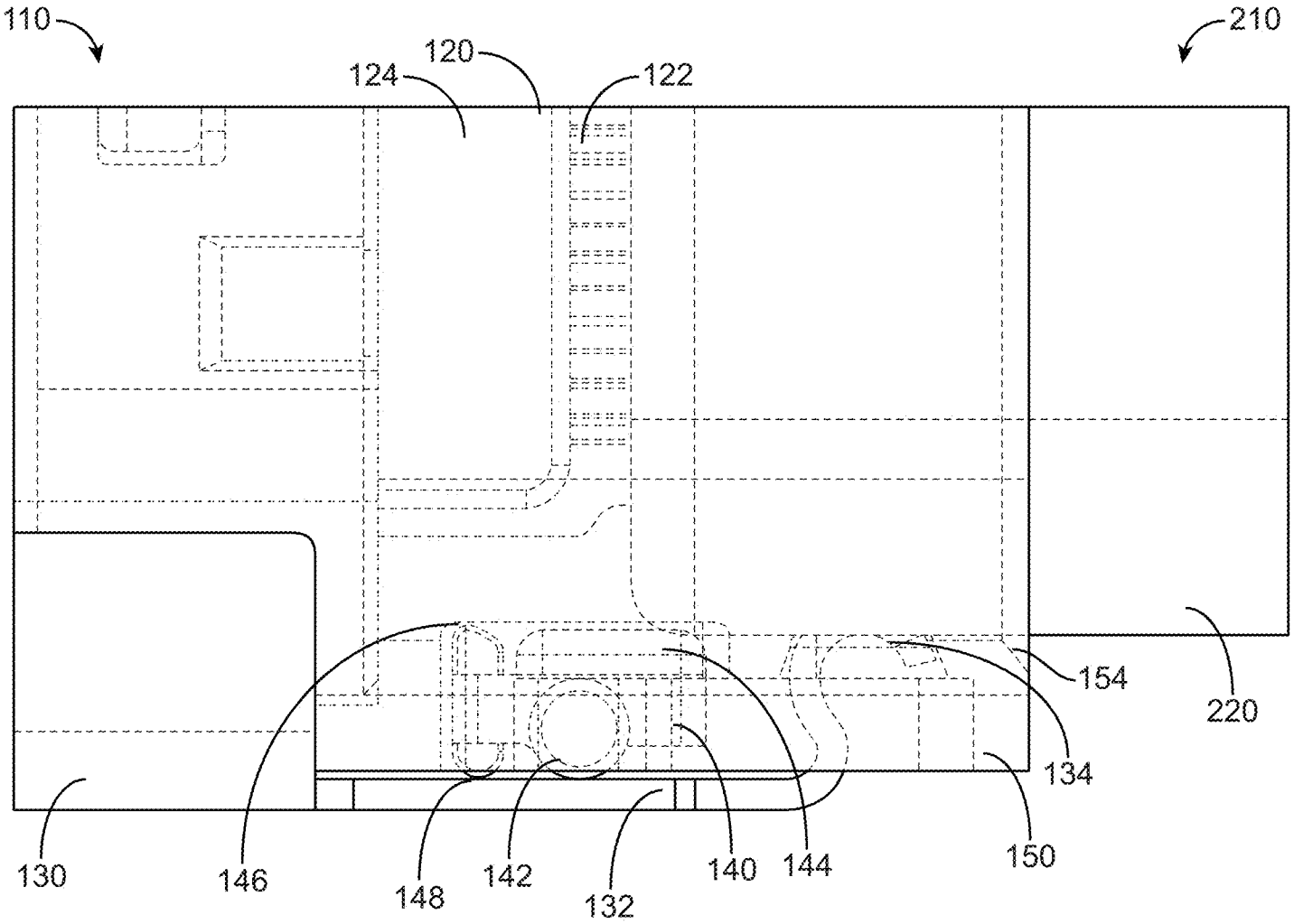
FIG. 2 illustrates a top view of a portion of a connector receptacle according to an embodiment of the present invention.

FIG. 2 illustrates a top view of a portion of a connector receptacle according to an embodiment of the present invention. This figure, as with the other included figures, is shown for illustrative purposes and does not limit other the possible embodiments of the present invention or the claims.

In this figure, connector insert 210 is partially inserted into connector receptacle 110. Connector insert 210 may be inserted into housing 150 of connector receptacle 110 through a front opening formed by passage 154. Connector receptacle 110 may include tongue 120 supporting a number of contacts 122 and ground pads 124 on a top and bottom side. Connector receptacle 110 may further include shield 130 having side ground spring 132. Side ground spring 132 may include contacting portion 134 to electrically connect to shield 220 on connector insert 210. Connector insert 210 may further include contacts (not shown) to mate with contacts 122 and ground pads 124 on tongue 120 in connector receptacle 110.

Connector receptacle 110 may further include one or more friction mechanisms 140. Friction mechanisms 140 may be located on each side of passage 154 in housing 150. Friction mechanisms 140 may include a high friction surface or friction pad 144. As connector insert 210 is inserted into connector receptacle 110, shield 220 may encounter friction pad 144. Friction pad 144 may increase a resistance that the user needs to overcome to insert connector insert 210 into connector receptacle 110. Friction mechanism 140 may be free to at least partially rotate about an axis defined by cam 142. Friction mechanism 140 may further include an engagement mechanism having an engagement mechanism front side 146 and an engagement mechanism backside 148. Engagement mechanism backside 148 may be located against an inside surface of side ground spring 132. As connector insert 210 is further inserted into connector receptacle 110, shield 220 may encounter engagement mechanism front side 146. This may cause friction mechanism 140 to at least try to rotate (counter clockwise in the drawing) such that engagement mechanism front side 146 provides a reduced force against shield 220. This rotation may help to limit and insertion force required to insert connector insert 210 into connector receptacle 110.

As connector insert 210 is extracted from connector receptacle 110, the extraction may cause friction mechanism 140 to at least try to rotate (clockwise in the drawing) such that engagement mechanism front side 146 is driven into shield 220 of connector receptacle 110. This may increase an extraction force required by a user to extract connector insert 210 from connector receptacle 110. As shield 220 passes engagement mechanism front side 146, friction pad 144 may provide a decreasing amount of friction against shield 220 as connector insert 210 is further extracted. Spring 138 may push against engagement mechanism backside 148 to return friction mechanism 140 to its original position.

Figure 3:
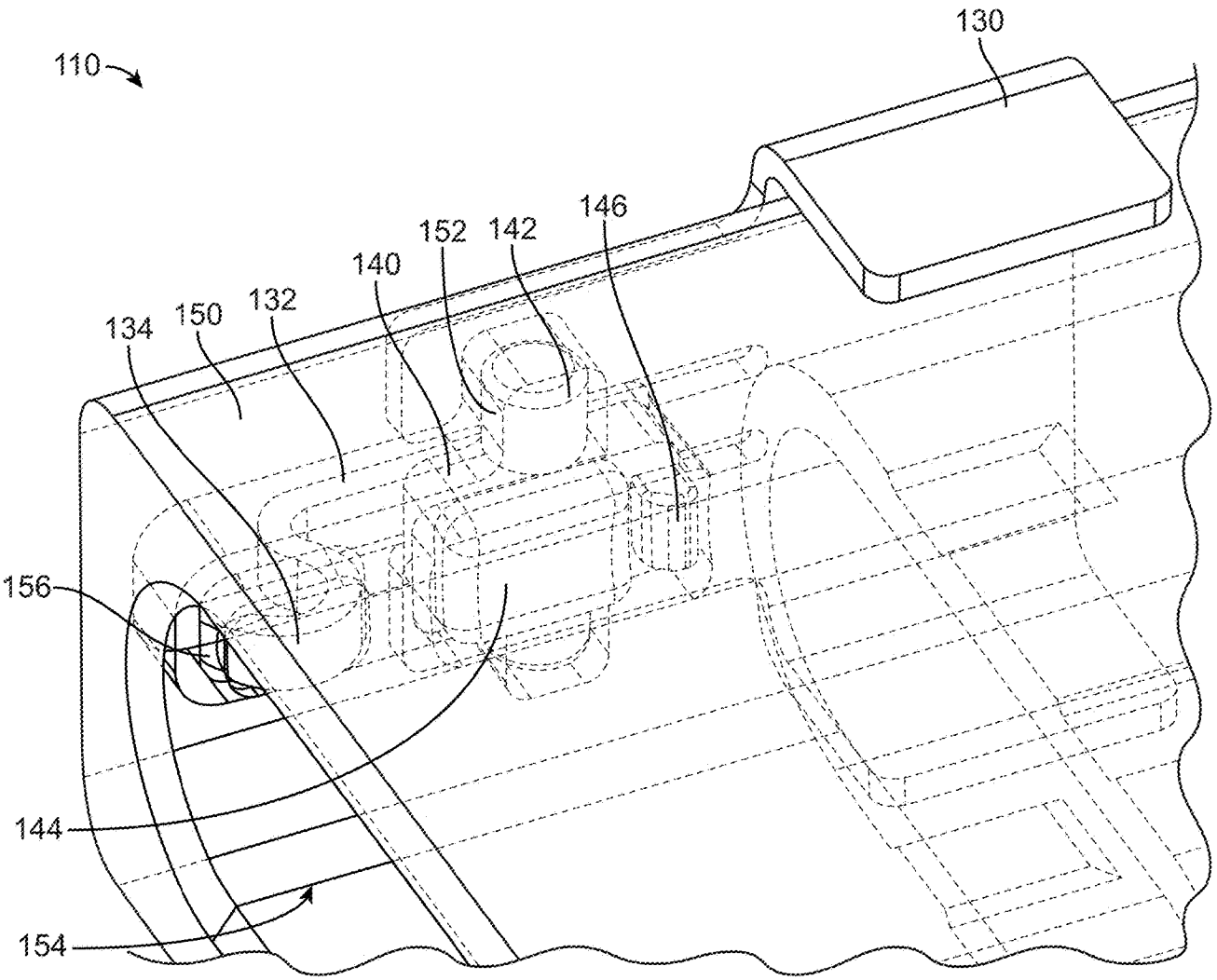
FIG. 3 illustrates a transparent side view of a friction mechanism according to an embodiment of the present invention.

FIG. 3 illustrates a transparent side view of a friction mechanism according to an embodiment of the present invention. Connector receptacle 110 may include housing 150 having passage 154. Passage 154 may accept corresponding connector insert 210 (shown in FIG. 2). Connector receptacle 110 may include shielding 130. Side ground spring 132 may extend from shielding 130 and may include contacting portion 134 at opening 156 in the side of housing 150. Contacting portion 134 may engage a shield of connector insert 210 when connector insert 210 is inserted into connector receptacle 110. Connector receptacle 110 may also include one or more friction mechanisms 140. Friction mechanisms 140 may include friction pad 144 and engagement mechanism front side 146 at opening 152 in a side of housing 150. Cam 142 may allow friction mechanism 140 to at least try to rotate in opening 152 during insertion and extraction of connector insert 210.

Figure 4:
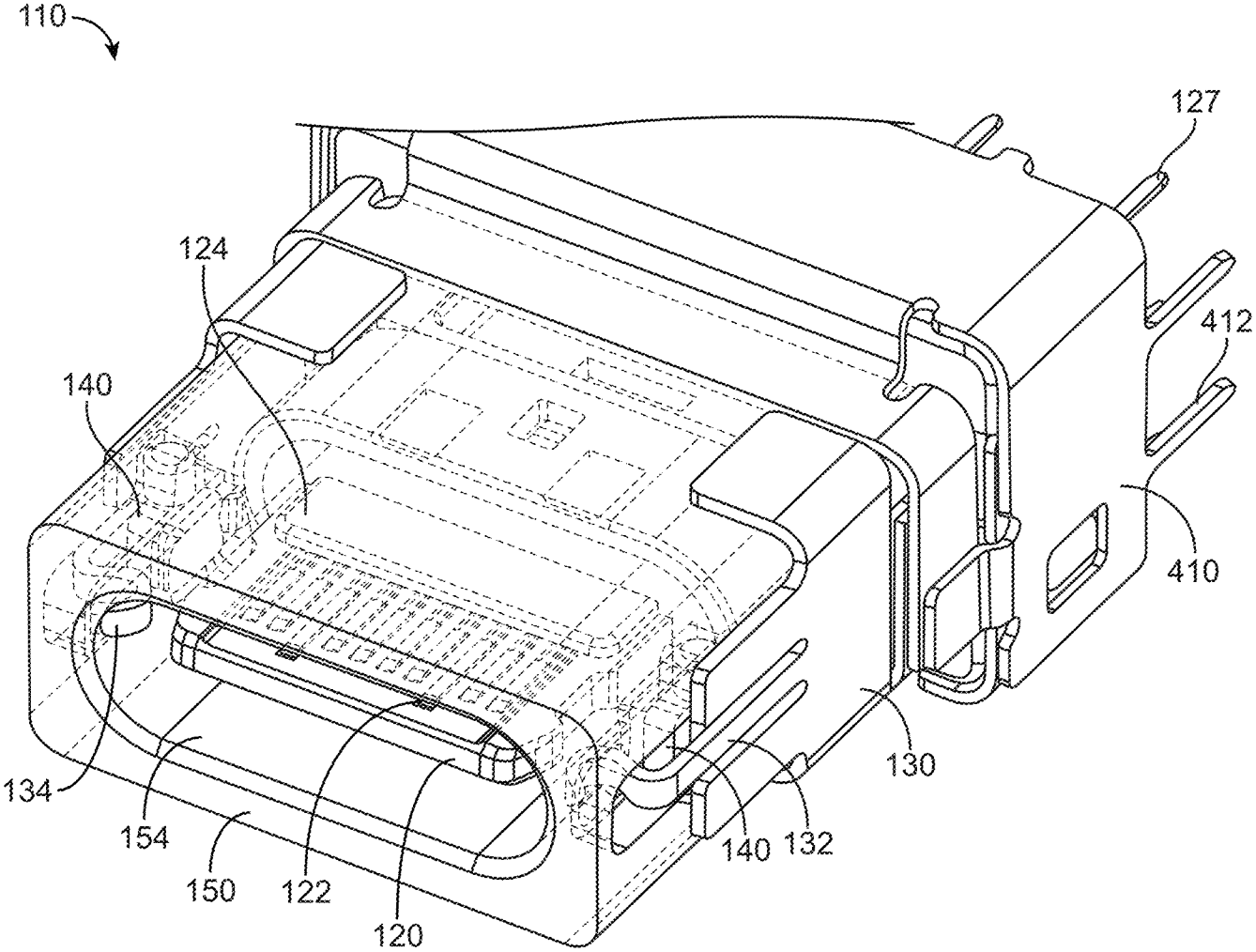
FIG. 4 illustrates a connector receptacle according to an embodiment of the present invention.

FIG. 4 illustrates a connector receptacle according to an embodiment of the present invention. Connector receptacle 110 may include housing 150 having passage 154. Tongue 120 may support a number of contacts 122 and ground pads 124 on top and bottom sides and may be located in passage 154. Connector receptacle 110 may include shield 130. Side ground springs 132 may extend from shield 130 and may include contacting portions 134. Contacting portions 134 may engage a shield of connector insert 210 (shown in FIG. 2) when connector insert 210 is inserted into this connector receptacle. Connector receptacle 110 may further include rear shield 410. Rear shield 410 may include tabs 412. Tabs 412 may be inserted into openings in a printed circuit board or other appropriate substrate (not shown) to connect shields 130 and 410 to ground. Contacts 122 may include contacting portions between ground pads 124 and a front opening in housing 150 defined by passage 154. Contacts 122 may further include tail portions 127, which may be inserted into openings to connect to traces and pads in the printed circuit board or other appropriate substrate. Connector receptacle 110 may further include friction mechanisms 140. A friction mechanism 140 may be located on each of the lateral sides of tongue 120 inside openings in housing 150.

Figure 5:
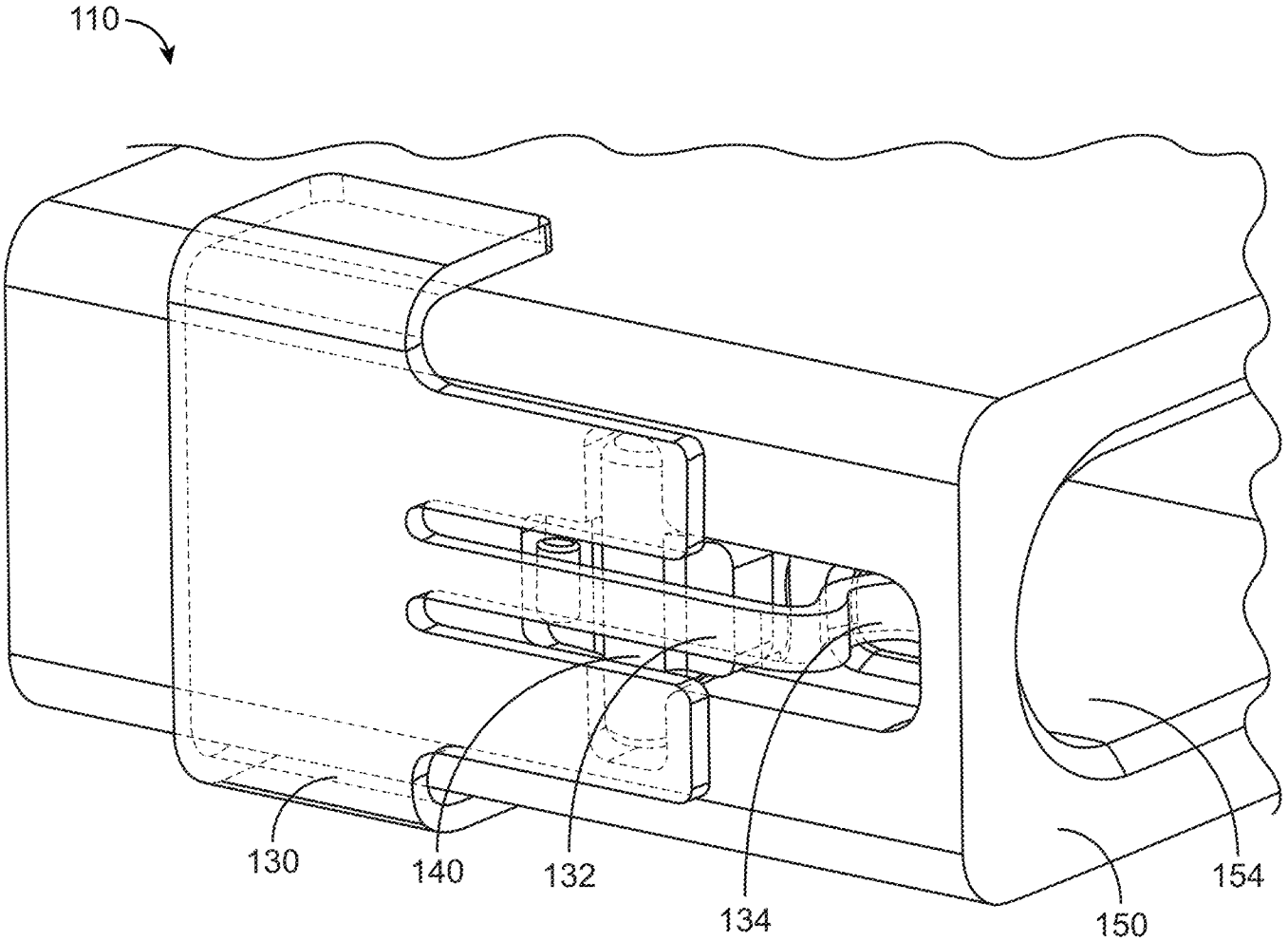
FIG. 5 illustrates a side view of a portion of a connector receptacle according to an embodiment of the present invention.

FIG. 5 illustrates a side view of a portion of a connector receptacle according to an embodiment of the present invention. Connector receptacle 110 may include housing 150 having a passage 154. Connector receptacle 110 may further include shield 130 supporting side ground springs 132 and contacting portions 134. Friction mechanisms 140 may be located in side openings in housing 150. Engagement mechanism backsides 148 may rest against side ground springs 132.

Figure 6:
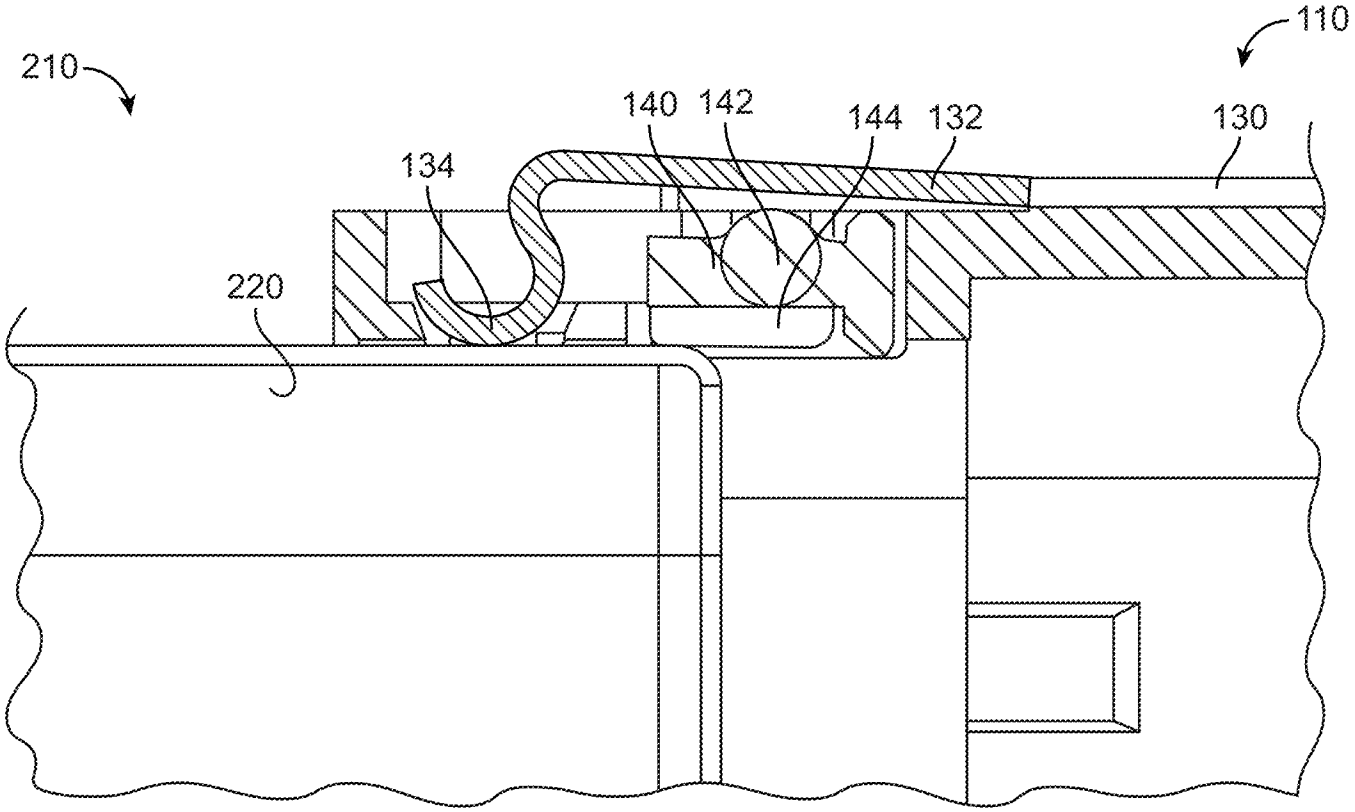
FIG. 6 illustrates a cutaway side view of a connector receptacle according to an embodiment of the present invention.

FIG. 6 illustrates a cutaway side view of a connector receptacle according to an embodiment of the present invention. In this example, connector insert 210 has been partially inserted into connector receptacle 110. Shield 220 may encounter contacting portion 134 of side ground spring 132, which may be an extension of shield 130. Shield 220 may also encounter friction pad 144 of friction mechanism 140. This encounter may cause friction mechanism 140 to at least try to rotate about cam 142 such that friction pad 144 provides a reduced force against shield 220. This may help to reduce an amount of force needed by user to insert connector insert 210 into connector receptacle 110.

Figure 7:
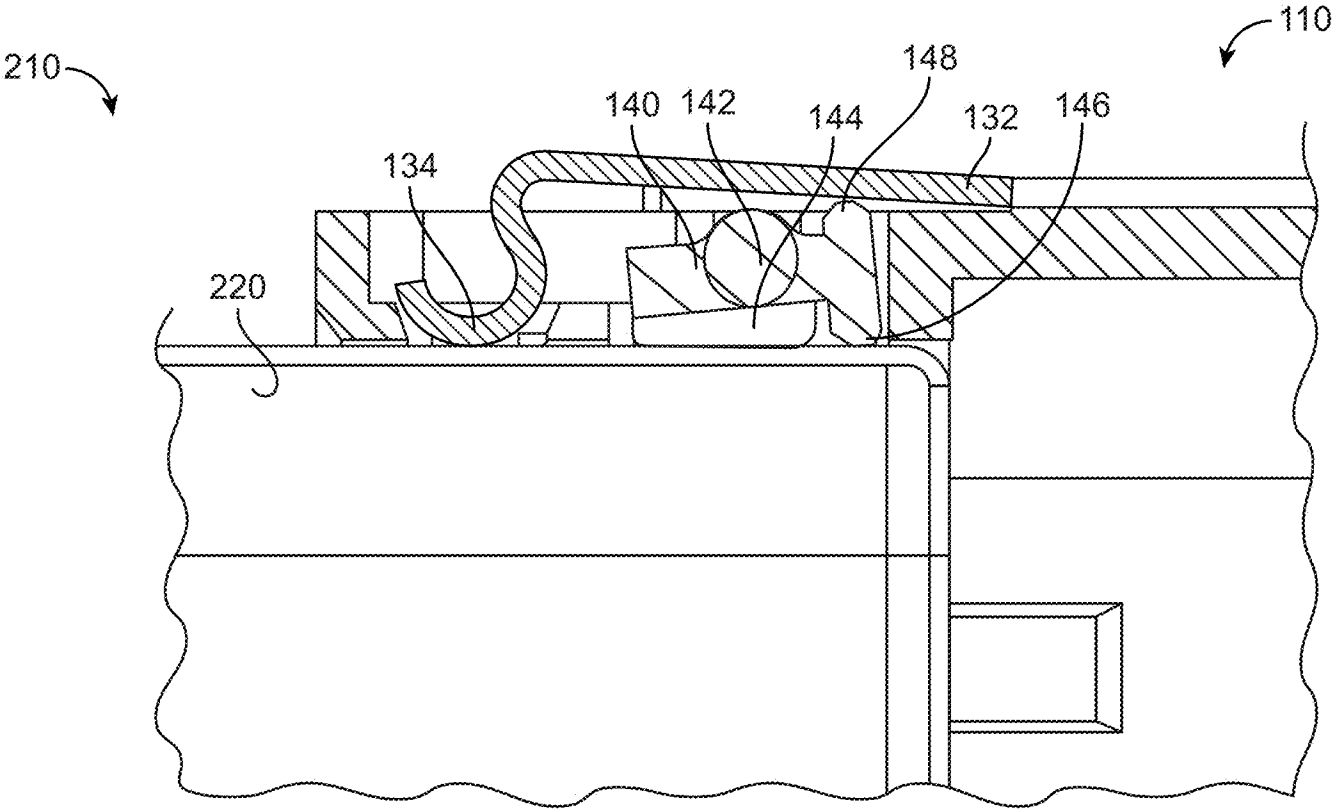
FIG. 7 illustrates another cutaway side view of a connector receptacle according to an embodiment of the present invention.

FIG. 7 illustrates another cutaway side view of a connector receptacle according to an embodiment of the present invention. In this example, connector insert 210 has been more fully inserted into connector receptacle 110. At this point, contacting portion 134 of side ground spring 132, friction pad 144, and engagement mechanism front side 146 are each in contact with shield 220. As connector insert 210 is pushed into connector receptacle 110, friction mechanism 140 may at least try to rotate about cam 142 such that engagement mechanism front side 146 provides a reduced force against shield 220. Engagement mechanism backside 148 may push against side ground spring 132, thereby reducing a force provided by contacting portion 134 against shield 220.

As connector insert 210 is extracted from connector receptacle 110, friction mechanism 140 may at least try to rotate about cam 142 such that engagement mechanism front side 146 is pushed more forcefully into shield 220. This may increase an extraction force that is necessary to extract connector insert 210 from connector receptacle 110 as compared to the required insertion force. Returning to FIG. 6, as connector insert 210 is fully withdrawn from connector receptacle 110, friction pad 144 may continue to provide a decreasing force against shield 220.

Figure 8:
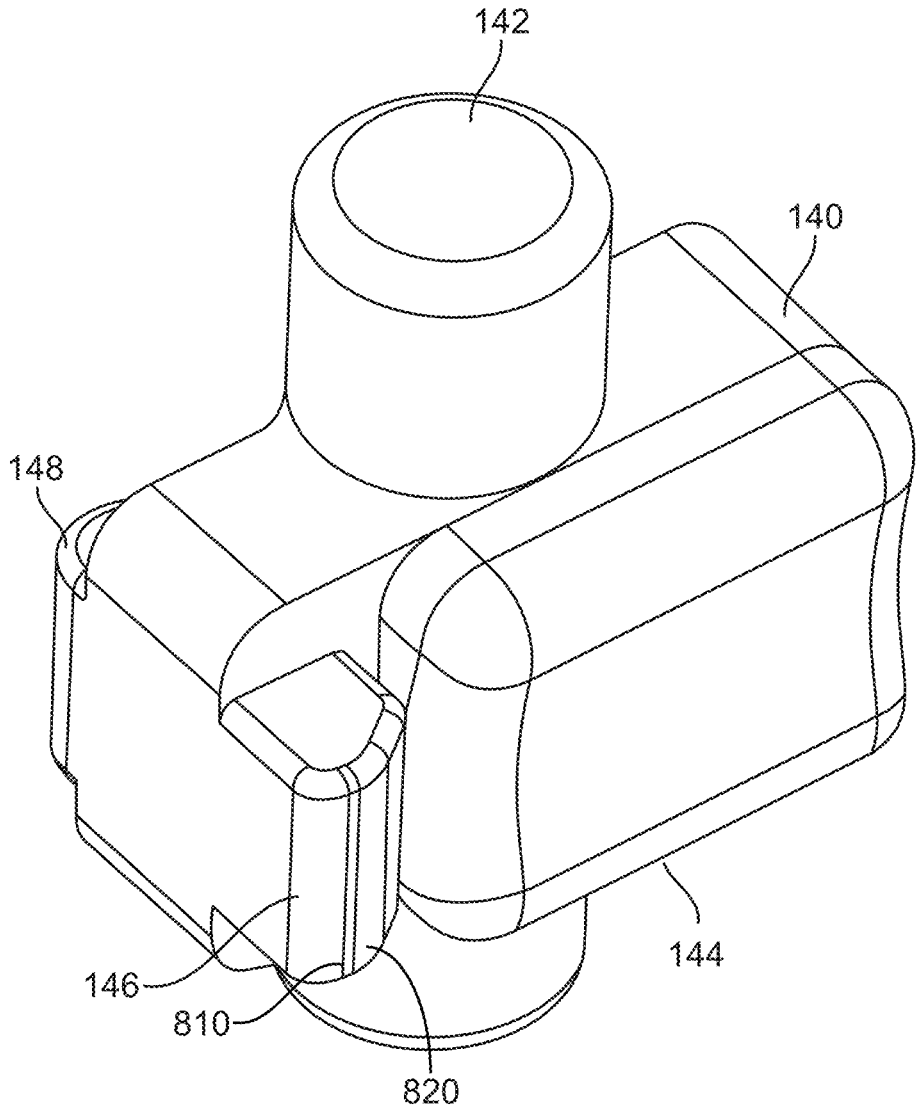
FIG. 8 illustrates a friction mechanism according to an embodiment of the present invention.

FIG. 8 illustrates a friction mechanism according to an embodiment of the present invention. Friction mechanism 140 may include cam 142, friction pad 144, engagement mechanism front side 146, and engagement mechanism backside 148. In this and other embodiments of the present invention, various surfaces of friction mechanism 140 may be coated with polytetrafluoroethylene or other low-friction material to decrease an amount of friction that may be provided during an insertion of connector insert 210 (shown in FIG. 2). Other various surfaces of friction mechanism 140 may be coated or formed of rubber to increase an amount of friction that may be provided during an extraction of connector insert 210. In this example, surface portion 810 of engagement mechanism front side 146 may have a higher friction substance at its surface, while surface portion 820 may have a lower friction substance at its surface. This may help to reduce friction against connector insert 210 as it is being inserted while increasing friction against connector insert 210 as it is being extracted.

Figure 9:
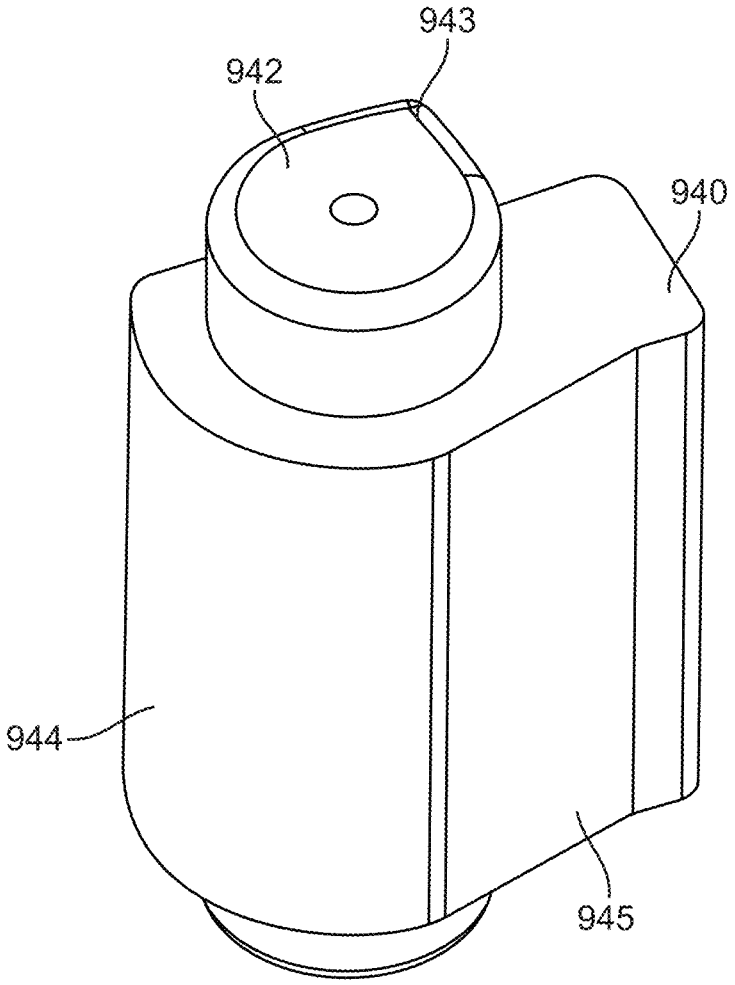
FIG. 9 illustrates another friction mechanism according to an embodiment of the present invention.

FIG. 9 illustrates another friction mechanism according to an embodiment of the present invention. Friction mechanism 940 may include cam 942. Cam 942 may include a cam feature 943. A first side of friction mechanism 940 may have a low-friction surface 945, while a second side may have a high-friction surface 944. As connector insert 210 (shown in FIG. 2) is inserted, it may ride against a low-friction surface 945, thereby reducing a required insertion force. As connector insert 210 is extracted, friction mechanism 940 may rotate such that high-friction surface 944 engages a shield of connector insert 210 and increases a required extraction force. This is shown further in the following figure.

Figure 10:
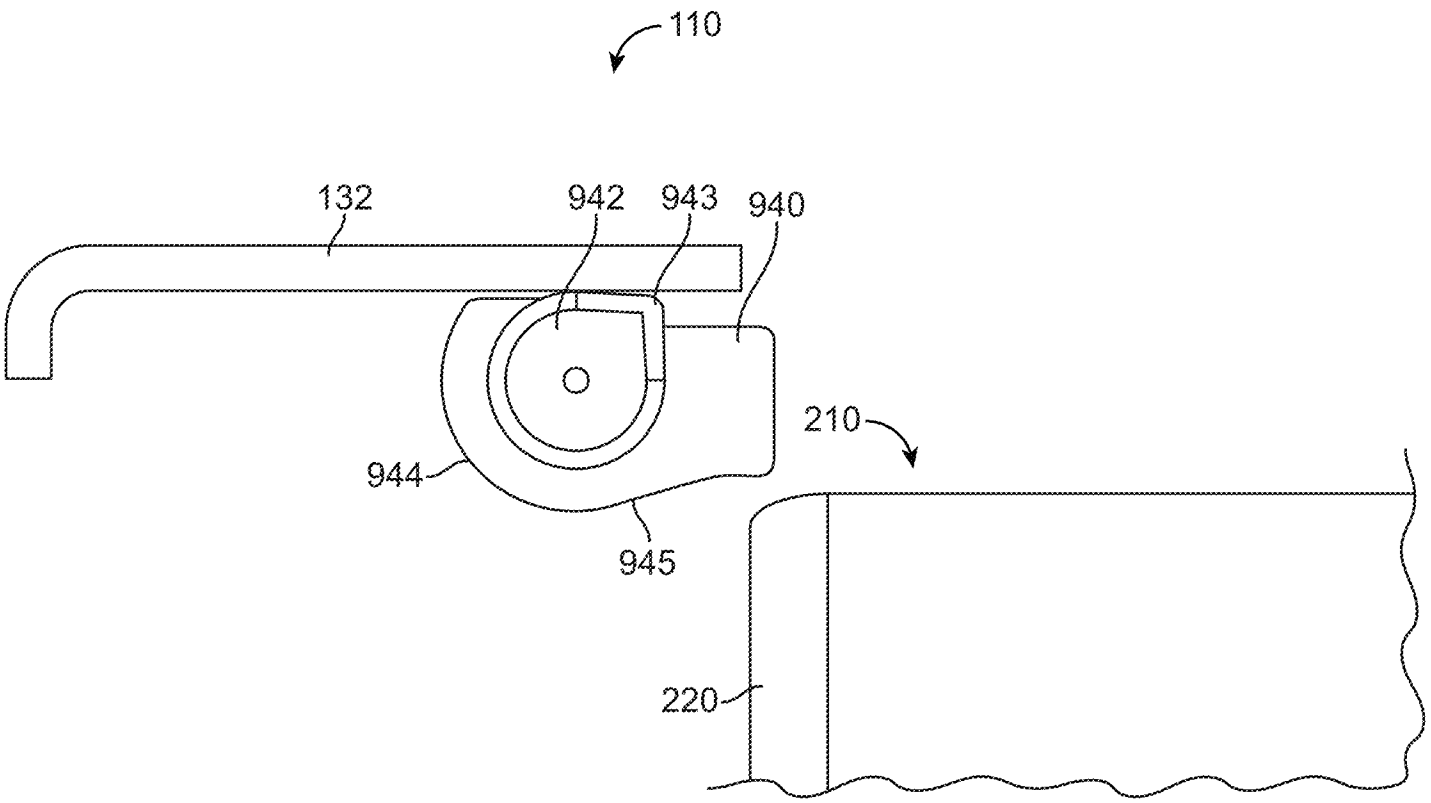
FIG. 10 illustrates a simplified connector receptacle according to an embodiment of the present invention.

FIG. 10 illustrates a simplified connector receptacle according to an embodiment of the present invention. In this example, shield 220 of connector insert 210 may be inserted into connector receptacle 110. As it is inserted, shield 220 may encounter low-friction surface 945. This may make it relatively easy to insert connector insert 210. As connector insert 210 is extracted, it may act to rotate friction mechanism 940 such that high-friction surface 944 engages shield 220. This may increase an extraction force required to extract connector insert 210 from connector receptacle 110. Cam feature 943 on cam 942 may push against side ground spring 132, thereby further increasing the force applied to shield 220 during an extraction.

Figure 11:
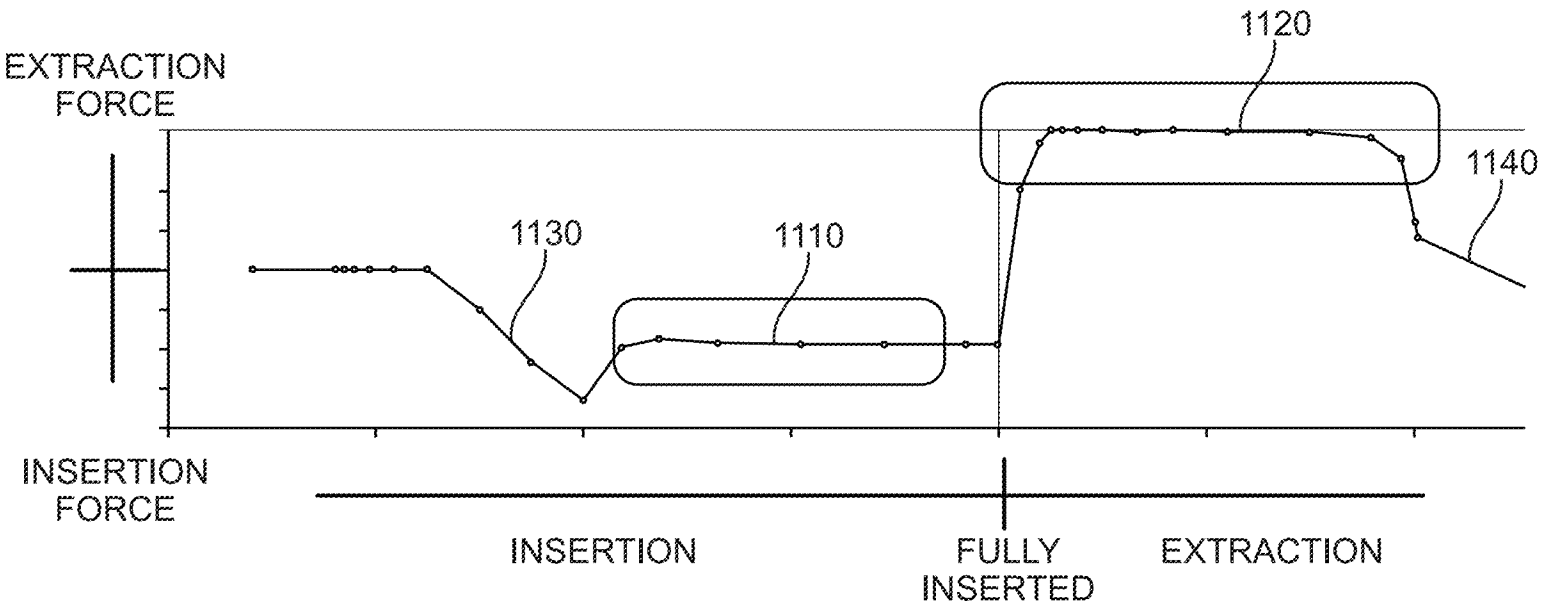
FIG. 11 is a graph illustrating forces required for an insertion and extraction of a connector insert into and out of a connector receptacle according to an embodiment of the present invention.

FIG. 11 is a graph illustrating forces required during an insertion and extraction of a connector insert into and out of a connector receptacle according to an embodiment of the present invention. In this figure, moving left to right, a connector insert is inserted and then extracted from connector receptacle. As the connector insert is inserted, a relatively low force shown as line segment 1110 is required. During extraction, a higher force shown by line segment 1120 may be necessary.

In regards to FIG. 8, as a connector insert engages friction pad 144, the insertion force required may begin to increase as shown as line segment 1130. As engagement mechanism front side 146 is engaged, the insertion force required may stay relatively level, as shown as line segment 1110. During extraction, friction mechanism 140 may rotate such that engagement mechanism front side 146 increases its force against the connector shield, shown as line segment 1120. As the shield is extracted past engagement mechanism front side 146, friction pad 144 may provide a reducing amount of friction, shown as line segment 1140. Again, the extraction force may be higher relative to the insertion force by providing a surface portion 810 having a higher friction than surface portion 820.

In regards to FIG. 9, during insertion a connector shield may engage low-friction surface 945, thereby providing proving friction as shown by line segment 1130. As the connector insert shield fully engages friction mechanism 940, the insertion force required may be relatively low, as shown as line segment 1110. During extraction, friction mechanism 940 may rotate about cam 942 thereby placing high-friction surface 944 against the connector insert shield. This may require a high extraction force be applied to remove the connector insert from the connector receptacle, shown as line segment 1120. As the connector shield passes high-friction surface 944, the extraction force may taper off as shown by line segment 1140.

Figure 12:
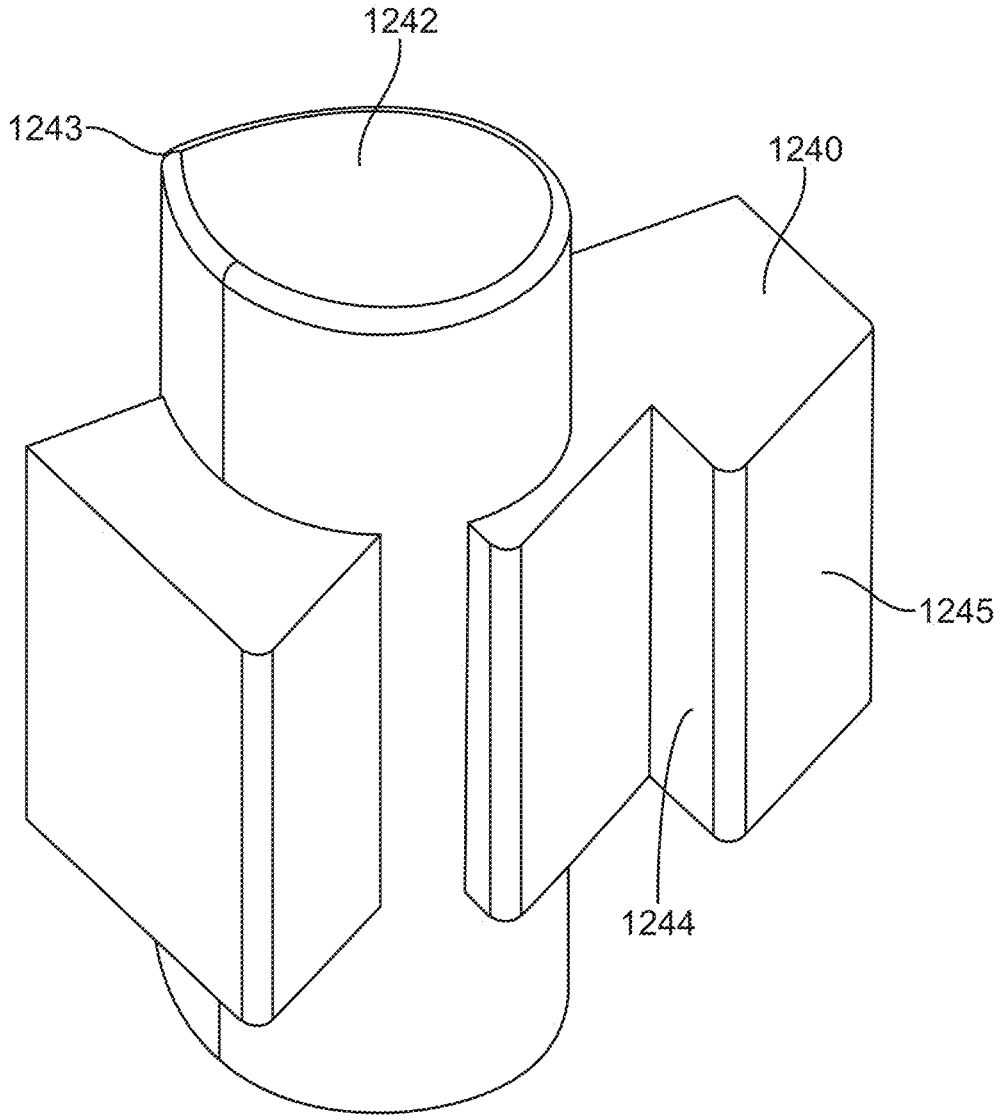
FIG. 12 illustrates another friction mechanism according to an embodiment of the present invention.

FIG. 12 illustrates another friction mechanism according to an embodiment of the present invention. Friction mechanism 1240 may include cam 1242 having cam feature 1243. Friction mechanism 1240 may include low friction surfaces 1245 for engaging a shield of connector insert 210 (shown in FIG. 2) during insertion, and high friction surfaces 1244 for engaging shield of connector insert 210 during an extraction.

These and other embodiments of the present invention may provide a connector receptacle having a locking mechanism to hinder or prevent extraction of a connector insert. These locking mechanisms may have a locked state and an unlocked state. The locking mechanisms may be manually toggled between locked and unlocked states using a switch, a slider, a touch switch, or other structure. The locking mechanisms may be electronically toggled between locked and unlocked states using electronic signals. Examples are shown in the following figures.

Figure 13:
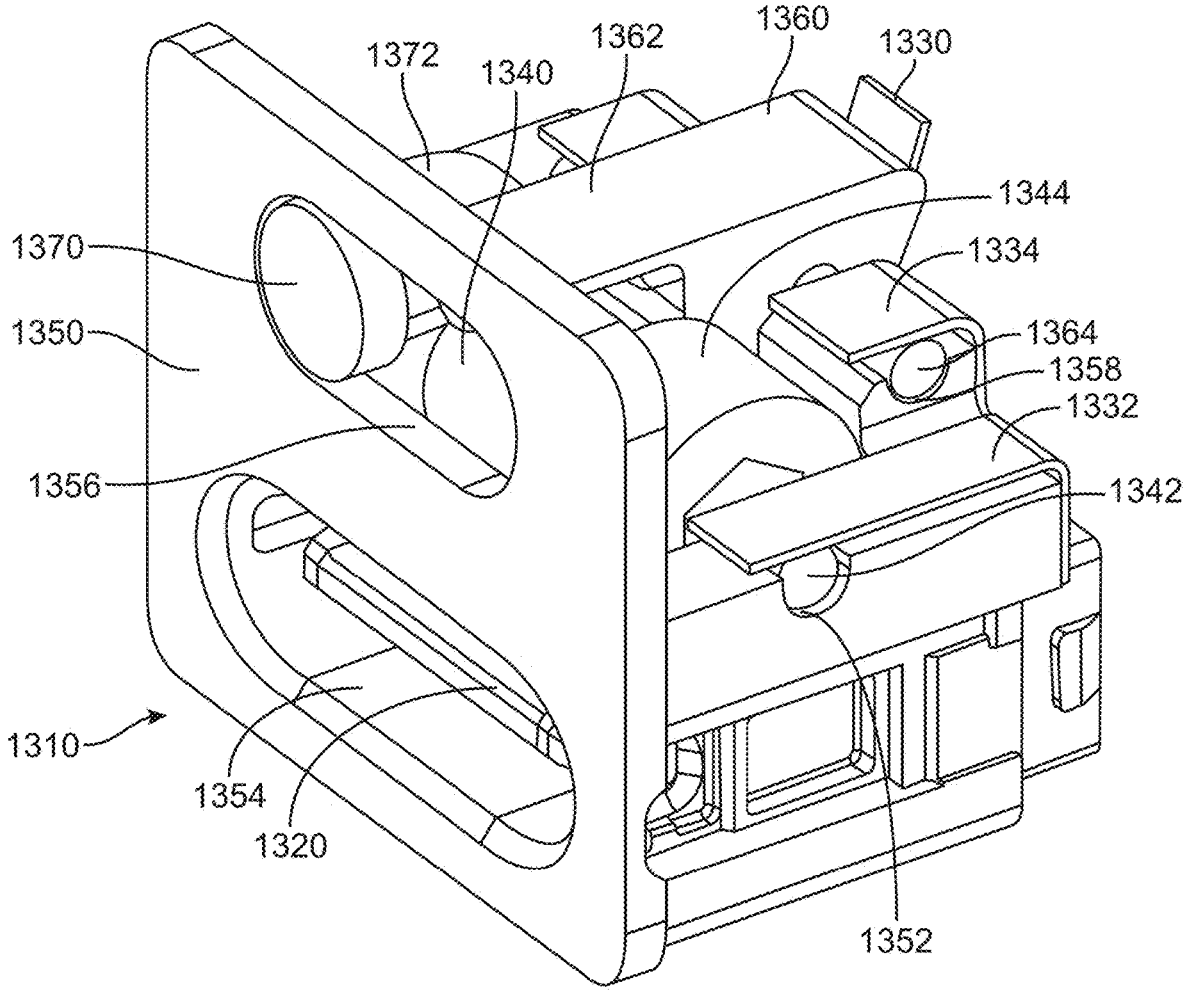
FIG. 13 illustrates a locking connector receptacle according to an embodiment of the present invention.

FIG. 13 illustrates a locking connector receptacle according to an embodiment of the present invention. Connector receptacle 1310, which may be used as connector receptacle 110 or 135 above, may include housing 1350 having a passage 1354 to accept corresponding connector insert 210 (shown in FIG. 2). Tongue 1320 may be located in passage 1354. Tongue 1320 may support a plurality of contacts and ground pads as shown in the above examples. Housing 1350 may include a second opening 1356. Switch 1370 may be located in opening 1356 of housing 1350. In this example, switch 1370 may be a sliding switch having a locked position and an unlocked position. In these and other embodiments of the present invention, switch 1370 may be another type of switch. For example, switch 1370 may be a push-push button switch that may unlock when the button is pushed and released, and may lock when the button is pushed and released again. Switch 1870 may be a push button switch, which may unlock when the button pushed in and may lock when the button is pushed again. In these and other embodiments of the present invention, switch 1870 may be another type of electrical, electromechanical, or mechanical switch. For example, switch 1870 may be a touch switch, toggle switch, or other switch. In this particular figure, switch 1370 is a slider switch that is shown in the locked position.

Connector receptacle 1310 may further include cam 1340, which may rotate about axis 1342 and may be held in place in cutout 1352 in housing 1350 by spring 1332. In this example, two friction wheels 1344 may be concentrically located around cam 1340. Friction wheels 1344 may engage a shield or other portion of connector insert 210 when connector insert 210 is inserted into passage 1354. Movement of connector insert 210 relative to connector receptacle 1310 may cause friction wheels 1344 and cam 1340 to rotate about axis 1342. Cam lock 1360 may include lever arm 1362, which may contact cam 1340. The lever arm 1362 may be pushed against cam 1340 by spring 1330. Cam lock 1360 may rotate about axis 1364 and may be held in place and cutout 1358 in housing 1350 by spring 1334. A user may slide switch 1370 to the right as shown in the figure, thereby lifting lever arm 1362 away from cam 1340 with ramp 1372 to unlock connector receptacle 1310.

When switch 1370 is in the unlocked position, ramp 1372 may lift lever arm 1362 away from cam 1340. At this time, a user may insert connector insert 210 into passage 1354. Cam 1340 may freely rotate about axis 1342, and the user may experience only a minor increase in a necessary insertion force. Similarly, when user extracts connector insert 210 from passage 1354, cam 1340 may again rotate freely about axis 1342, and a user may experience only a minor increase in a necessary extraction force.

When switch 1370 is in the locked position, lever arm 1362 may be against cam 1340. When a user inserts connector insert 210 into passage 1354, cam 1340 may rotate with only a minor increase in friction due to lever arm 1362, and the user may experience only minor increase in necessary insertion force, though in various embodiments of the present invention, this force may be higher than when switch 1370 is in the unlocked position. When a user extracts connector insert 210 from passage 1354, cam 1340 may bind with cam lock 1360 and prevent rotation of cam 1340. This may effectively lock connector insert 210 in place in connector receptacle 1310.

When switch 1370 is in the locked position, spring 1330 may provide a downward force through cam lock 1360 and lever arm 1362 to push down on cam 1340, thereby increasing a force from friction wheels 1344 against connector insert 210 in passage 1354. This force may act to hold connector insert 210 in place.

Figure 14:
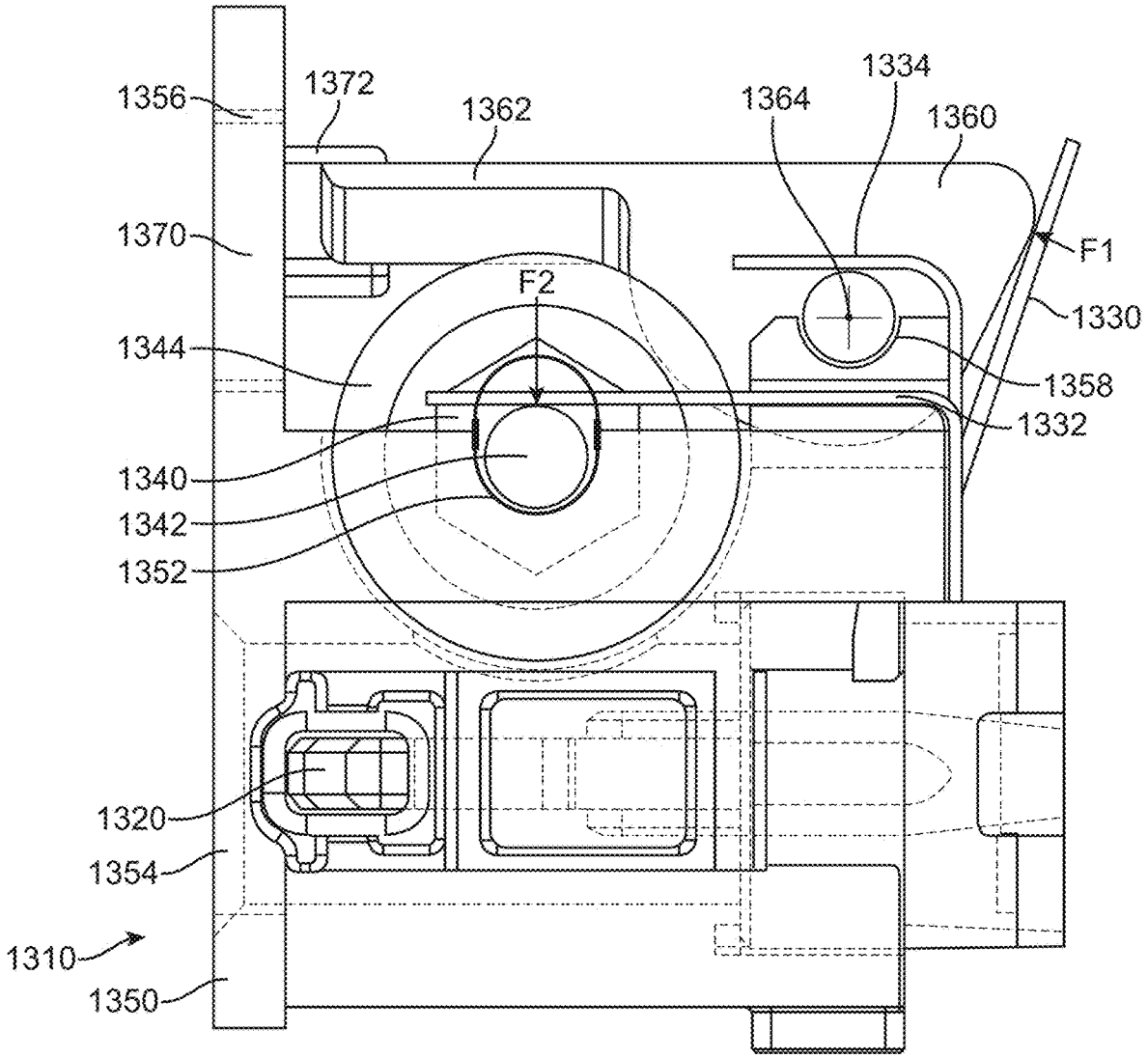
FIG. 14 is a side view of a connector receptacle according to an embodiment of the present invention.

FIG. 14 is a side view of a connector receptacle according to an embodiment of the present invention. Connector receptacle 1310 may include passage 1354 in housing 1350. Connector insert 210 (shown in FIG. 2) may be inserted into passage 1354 and may make electrical contact with contacts and pads on tongue 1320. Housing 1350 may include a second opening 1356 for switch 1370. Switch 1370 may include ramp 1372 that may separate lever arm 1362 from cam 1340, thereby unlocking connector receptacle 1310. When the connector receptacle is locked, ramp 1372 may be moved out of the way allowing of lever arm 1362 to engage cam 1340. Cam 1340 may rotate about axis 1342 and may include friction wheels 1344. Friction wheels 1344 may engage a shield or a portion of connector insert 210 when connector insert 210 is inserted into passage 1354 in housing 1350. Cam 1340 may be held in place in cutout 1352 in housing 1350 by spring 1332. Cam lock 1360 may rotate about axis 1364 and may be held in place in cutout 1358 in housing 1350 by spring 1334. Spring 1330 may apply a force F1 that may push lever arm 1362 against cam 1340. Force F1 may then generate a force F2 pushing cam 1340 downward.

Figure 15:
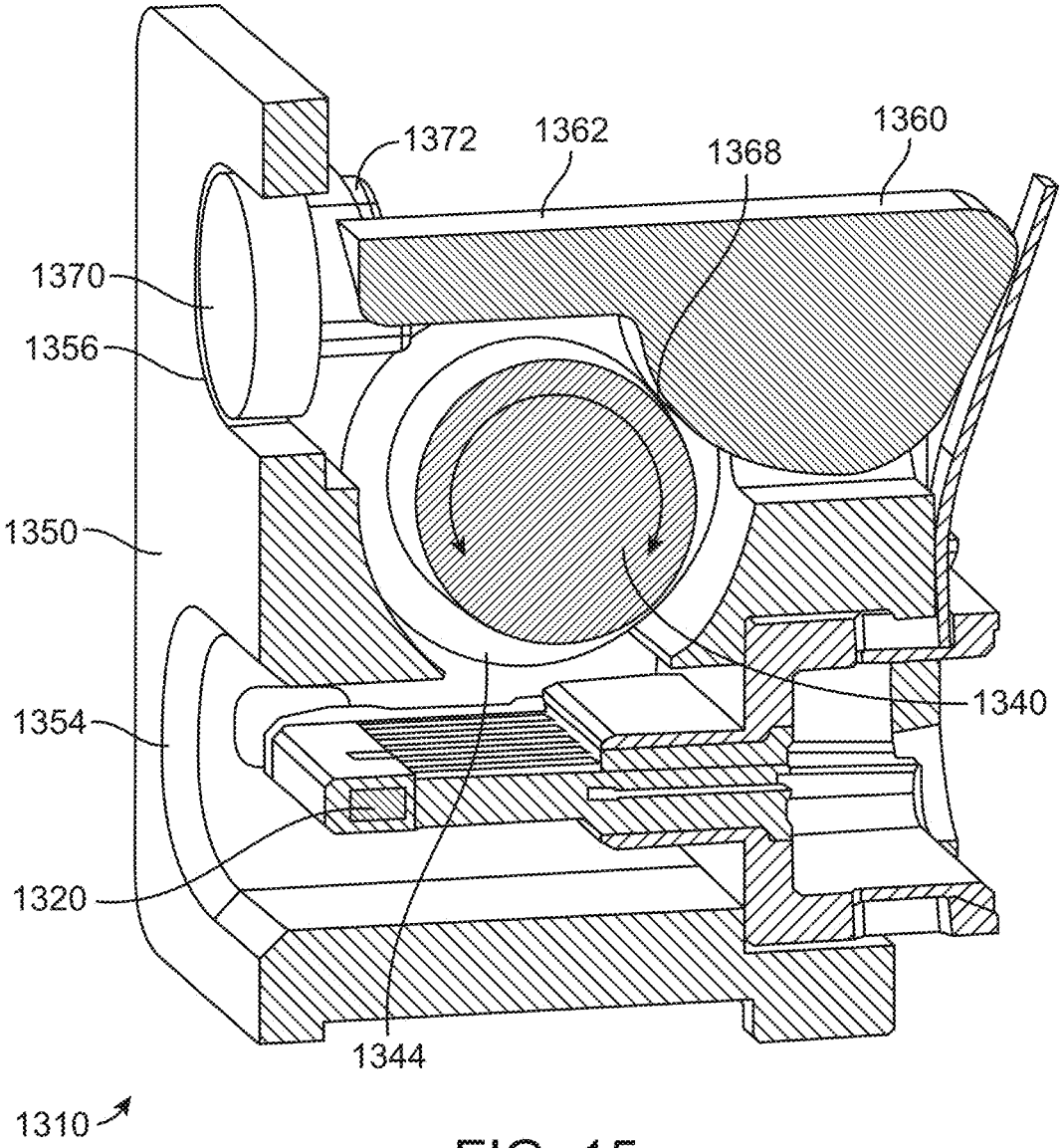
FIG. 15 is a cutaway side view of a connector receptacle according to an embodiment of the present invention.

FIG. 15 is a cutaway side view of a connector receptacle according to an embodiment of the present invention. Housing 1350 may include passage 1354 for accepting connector insert 210 (shown in FIG. 2). Connector insert 210 may engage contacts and ground pads on tongue 1320. Housing 1350 may include a second opening 1356 for switch 1370. Switch 1370 may be slid back and forth in opening 1356 by a user. Switch 1370 may include ramp 1372.

When switch 1370 is in an unlocked position, ramp 1372 may lift lever arm 1362 of cam lock 1360 away from cam 1340 thereby allowing cam 1340 to rotate freely about axis 1342. When switch 1370 is in a locked position, lever arm 1362 may contact cam 1340. At this time, when connector insert 210 is inserted into passage 1354, connector insert 210 may encounter friction wheel 1344. The insertion may cause cam 1340 to rotate in a counterclockwise direction as shown in the figure. When cam 1340 rotates in a counterclockwise direction, cam 1340 may engage location 1368 on cam lock 1360. This may act to push lever arm 1362 up away from cam 1340 such that cam 1340 may more easily rotate about axis 1342. During extraction, cam 1340 may try to rotate in a clockwise direction. When this occurs, cam 1340 may again engage location 1368 on lever arm 1362. The clockwise rotation of cam 1340 may drive lever arm 1362 into cam 1340 thereby hindering or preventing its rotation. This may further hinder or prevent extraction of connector insert 210 from passage 1354.

Figure 16:
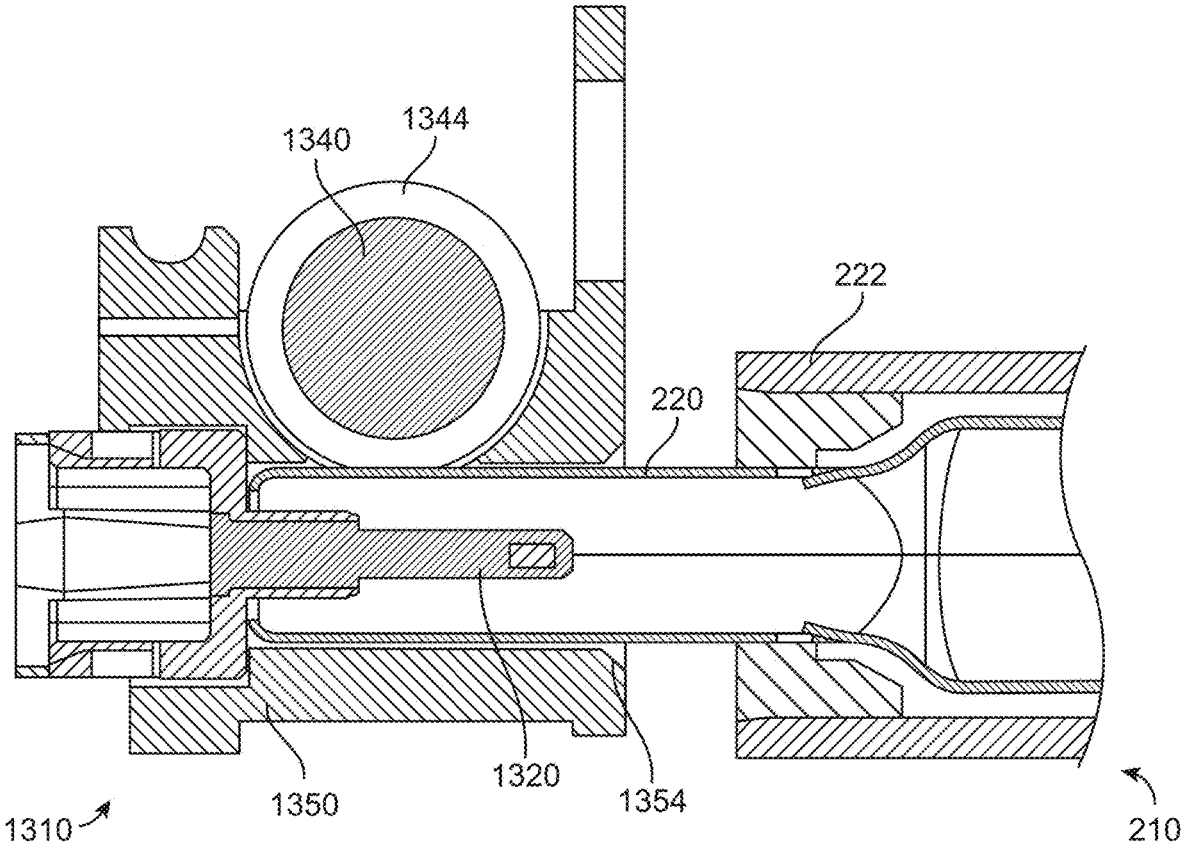
FIG. 16 is another side view of a connector receptacle according to an embodiment of the present invention.

FIG. 16 is another side view of a connector receptacle according to an embodiment of the present invention. In this example, cam 1340 may include friction wheel 1344. Friction wheel 1344 may be circumferentially located around a length of cam 1340. Connector insert 210 may be inserted into passage 1354 of housing 1350. Friction wheel 1344 may engage shield 220 of connector insert 210. Connector insert 210 may further include housing 222. Contacts (not shown) in connector insert 210 may engage contacts 122 and ground pads 124 (shown in FIG. 2) on tongue 1320.

Figure 17:
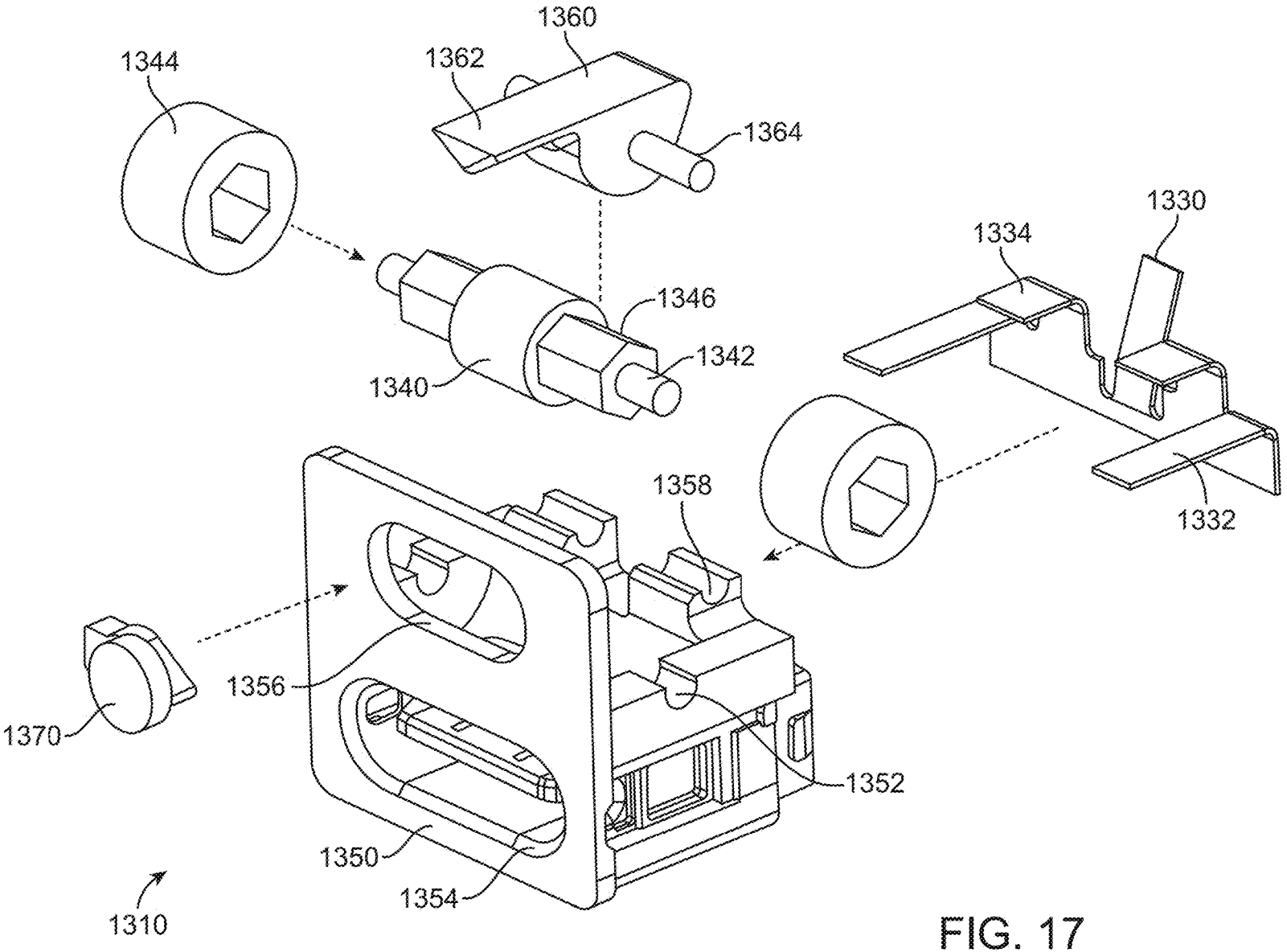
FIG. 17 is an exploded diagram of a connector receptacle according to an embodiment of the present invention.

FIG. 17 is an exploded diagram of a connector receptacle according to an embodiment of the present invention. Connector receptacle 1310 may include housing 1350. Housing 1350 may include passage 1354 for accepting connector insert 210 (shown in FIG. 2). Housing 1350 may further include a second opening 1356 for switch 1370. Cam 1340 may rotate about axis 1342 and may include angled surfaces 1346. Angled surfaces 1346 may secure friction wheels 1344 in place. Cam 1340 may be held in place in cutouts 1352 in housing 1350 by springs 1332. Cam lock 1360 may include lever arm 1362. Cam lock 1360 may rotate about axis 1364 and may be held in place in cutouts 1358 in housing 1350 by springs 1334. Spring 1330 may provide a force to cam lock 1360 to push lever arm 1362 against cam 1340 when connector receptacle 310 is in the locked position. Connector receptacle 310 may be unlocked by a user sliding switch 1370 such that lever arm 1362 is separated from cam 1340.

Figure 18:
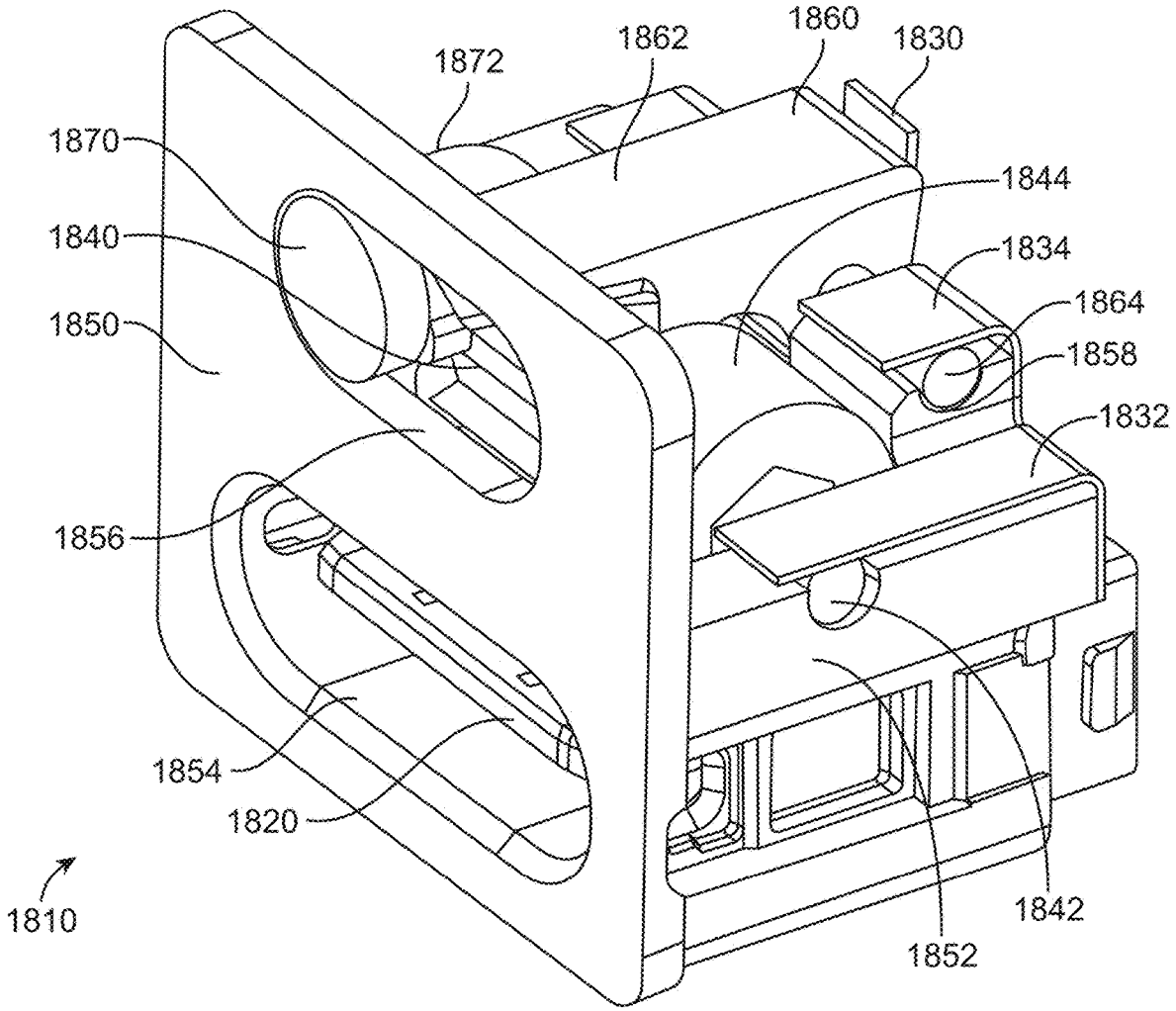
FIG. 18 illustrates a locking connector receptacle according to an embodiment of the present invention.

FIG. 18 illustrates a locking connector receptacle according to an embodiment of the present invention. Connector receptacle 1810, which may be used as connector receptacle 110 and 135 above, may include housing 1850 having a passage 1854 to accept corresponding connector insert 210 (shown in FIG. 2). Tongue 1820 may be located in passage 1854. Tongue 1820 may support a plurality of contacts and ground pads as shown in the above examples. Housing 1850 may include a second opening 1856. Switch 1870 may be located in opening 1856 of housing 1850. In this example, switch 1870 may be a sliding switch having a locked position and an unlocked position. In these and other embodiments of the present invention, switch 1870 may be another type of switch. For example, switch 1870 may be a push-push button switch that may unlock when the button is pushed and released, and may lock when the button is pushed and released again. Switch 1870 may be a push button switch, which may unlock when the button pushed in and may lock when the button is pushed again. In these and other embodiments of the present invention, switch 1870 may be another type of electrical, electromechanical, or mechanical switch. For example, switch 1870 may be a touch switch, toggle switch, or other switch. In this particular figure, switch 1870 is a slider switch shown in the locked position.

Connector receptacle 1810 may further include gear 1840, which may rotate about axis 1842 and may be held in place in cutout 1852 in housing 1850 by spring 1832. In this example, two friction wheels 1844 may be concentrically located around gear 1840. Friction wheels 1844 may engage a shield or other portion of connector insert 210 when connector insert 210 is inserted into passage 1854. Movement of connector insert 210 relative to connector receptacle 1810 may cause friction wheels 1844 and gear 1840 to rotate about axis 1842. Gear 1840 may include a number of ratchet teeth 1849 (shown in FIG. 19.) Gear lock 1860 may include lever arm 1862 that may support tooth 1869 (shown in FIG. 19.) Teeth 1849 on gear 1840 may engage tooth 1869 on lever arm 1862. The lever arm 1862 may be pushed against gear 1840 by spring 1830. Gear lock 1860 may rotate about axis 1864 and may be held in place and cutout 1858 in housing 1850 by spring 1834. A user may slide switch 1870 to the right as shown in the figure, thereby lifting lever arm 1862 away from gear 1840 with ramp 1872 and disengaging tooth 1869 from teeth 1849.

When switch 1870 is in the unlocked position, ramp 1872 may lift lever arm 1862 away from gear 1840 thereby disengaging tooth 1869 from teeth 1849. At this time, a user may insert connector insert 210 into passage 1854. Gear 1840 may freely rotate about axis 1842, and the user may experience only a minor increase in a necessary insertion force. Similarly, when user extracts connector insert 210 from passage 1854, gear 1840 may again rotate freely about axis 1842, and a user may experience only a minor increase in a necessary extraction force.

When switch 1870 is in the locked position, lever arm 1862 may be against gear 1840 and tooth 1869 may engage teeth 1849. When a user inserts connector insert 210 into passage 1854, gear 1840 may rotate with only a minor increase in friction due to the angled ratchet teeth 1849, and the user may experience only minor increase in necessary insertion force, though in various embodiments of the present invention, this force may be higher than when switch 1870 is in the unlocked position. When a user extracts connector insert 210 from passage 1854, teeth 1849 may be locked in place by tooth 1869 to prevent rotation of gear 1840. This may effectively lock connector insert 210 in place in connector receptacle 1810.

When switch 1870 is in the locked position, spring 1830 may provide a downward force through gear lock 1860 and lever arm 1862 to push down on gear 1840, thereby increasing a force from friction wheels 1844 against connector insert 210 in passage 1854. This force may act to hold connector insert 210 in place.

Figure 19:
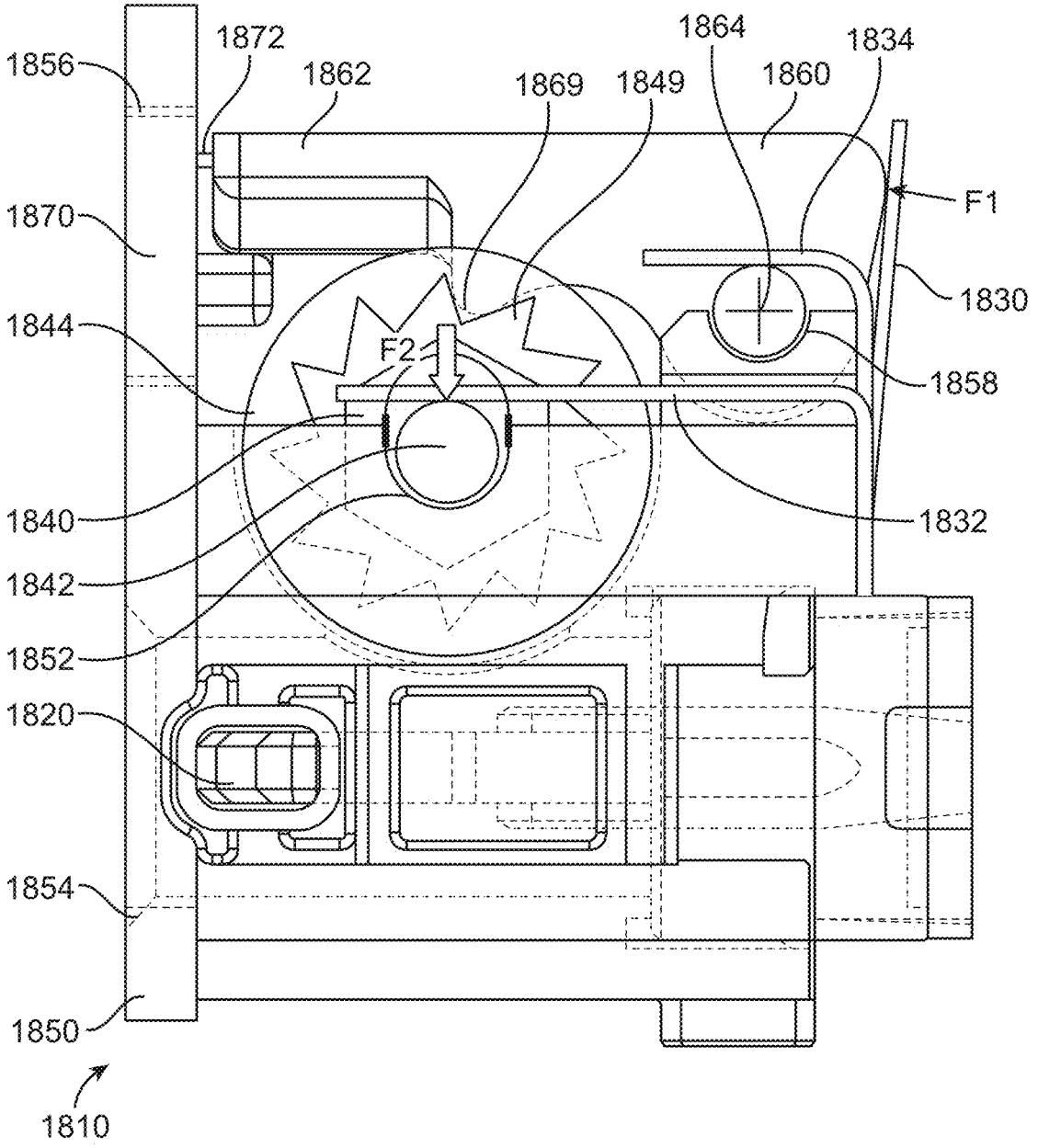
FIG. 19 is a side view of a connector receptacle according to an embodiment of the present invention

FIG. 19 is a side view of a connector receptacle according to an embodiment of the present invention. Connector receptacle 1810 may include passage 1854 in housing 1850. Connector insert 210 (shown in FIG. 2) may be inserted into passage 1854 and may make electrical contact with contacts 122 and ground pads 124 (shown in FIG. 2) on tongue 1820. Housing 1850 may include a second opening 1856 for switch 1870. Switch 1870 may include ramp 1872 that may separate lever arm 1862 from gear 1840, thereby disengaging teeth 1849 from tooth 1869 and unlocking connector receptacle 1810. When the connector receptacle is locked, ramp 1872 may be moved out of the way allowing of lever arm 1862 to engage gear 1840. Gear 1840 may rotate about axis 1842 and may include friction wheels 1844. Friction wheels 1844 may engage a shield or a portion of connector insert 210 when connector insert 210 is inserted into passage 1854 in housing 1850. Gear 1840 may be held in place in cutout 1852 in housing 1850 by spring 1832. Gear lock 1860 may rotate about axis 1864 and may be held in place in cutout 1858 in housing 1850 by spring 1834. Spring 1830 may apply a force F1 that may push lever arm 1862 against gear 1840. Force F1 may then generate a force F2 pushing gear 1840 downward.

Figure 20:
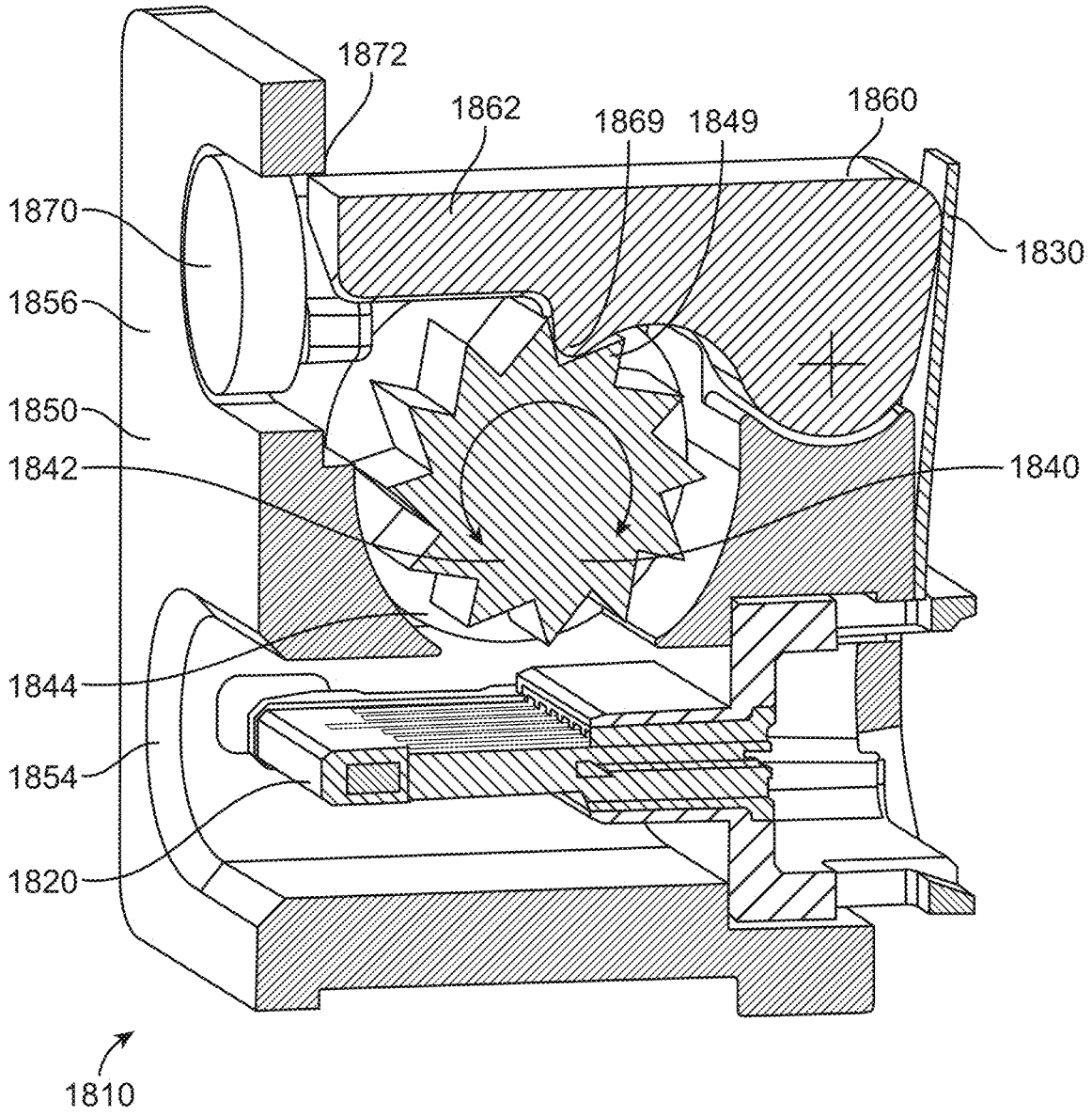
FIG. 20 is a cutaway side view of a connector receptacle according to an embodiment of the present invention.

FIG. 20 is another side view of a connector receptacle according to an embodiment of the present invention. In this example, gear 1840 may include friction wheel 1844. Friction wheel 1844 may be circumferentially located around a length of gear 1840. Connector insert 210 (shown in FIG. 2) may be inserted into passage 1854 of housing 1850. Friction wheel 1844 may engage shield 220 (shown in FIG. 2) or other portion of connector insert 210. Contacts (not shown) in connector insert 210 may engage contacts 122 and ground pads 124 (shown in FIG. 2) on tongue 1820.

When switch 1870 is in an unlocked position, ramp 1872 may lift lever arm 1862 of gear lock 1860 away from gear 1840 thereby disengaging teeth 1849 from tooth 1869 and allowing gear 1840 to rotate freely about axis 1842. When switch 1870 is in a locked position in opening 1856, lever arm 1862 may contact gear 1840 and tooth 1869 may engage teeth 1849. At this time, when connector insert 210 is inserted into passage 1854, connector insert 210 may encounter friction wheel 1844. The insertion may cause gear 1840 to rotate in a counterclockwise direction as shown in the figure. When gear 1840 rotates in a counterclockwise direction, the angled ratchet teeth 1849 may move relative to tooth 1869. During extraction, gear 1840 may try to rotate in a clockwise direction. When this occurs tooth 1869 may engage angled teeth 1849 and hold gear 1840 in place, thereby hindering or preventing its rotation. This may further hinder or prevent extraction of connector insert 210 from passage 1854.

Figure 21:
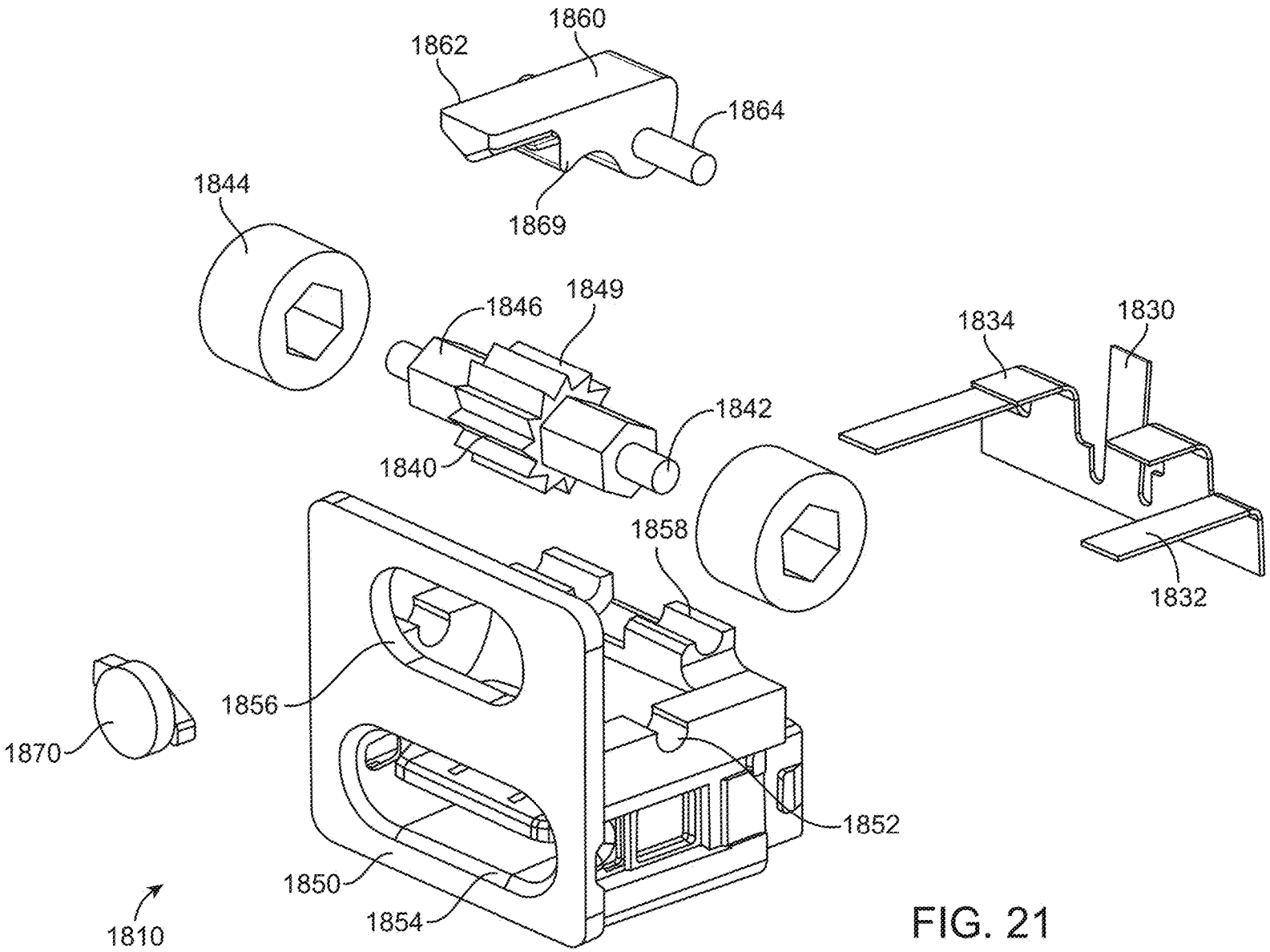
FIG. 21 is an exploded diagram of a connector receptacle according to an embodiment of the present invention.

FIG. 21 is an exploded diagram of a connector receptacle according to an embodiment of the present invention. Connector receptacle 1810 may include housing 1850. Housing 1850 may include passage 1854 for accepting connector insert 210 (shown in FIG. 2). Housing 1850 may further include a second opening 1856 for switch 1870. Gear 1840 may rotate about axis 1842 and may include angled surfaces 1846. Angled surfaces 1846 may secure friction wheels 1844 in place. Gear 1840 may be held in place in cutouts 1852 in housing 1850 by springs 1832. Gear lock 1860 may include lever arm 1862. Gear lock 1860 may rotate about axis 1864 and may be held in place in cutouts 1858 in housing 1850 by springs 1834. Spring 1830 may provide a force to gear lock 1860 to push lever arm 1862 against gear 1840 when connector receptacle 310 is in the locked position. Connector receptacle 310 may be unlocked by a user sliding switch 1870 such that lever arm 1862 is separated from gear 1840.

While embodiments of the present invention may be useful as USB Type-C connector receptacles, these and other embodiments of the present invention may be used as connector receptacles in other types of connector systems.

In various embodiments of the present invention, contacts, ground pads, springs, shields, cams, cam locks, gear, gear locks, and other portions of a connector receptacle may be formed by stamping, metal-injection molding, machining, micro-machining, 3-D printing, or other manufacturing process. These portions may be formed of stainless steel, steel, copper, copper titanium, phosphor bronze, or other material or combination of materials. They may be plated or coated with nickel, gold, or other material. Other portions, such as housings, friction wheels, and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials.

Embodiments of the present invention may provide connector receptacles that may be located in, and may connect to, various types of devices, such as portable computing devices, tablet computers, desktop computers, laptops, all-in-one computers, wearable computing devices, smart phones, storage devices, portable media players, navigation systems, monitors, power supplies, video delivery systems, adapters, remote control devices, chargers, and other devices. These connector receptacles may provide interconnect pathways for signals that are compliant with various standards such as one of the Universal Serial Bus standards including USB Type-C, High-Definition Multimedia Interface, Digital Visual Interface, Ethernet, DisplayPort, Thunderbolt, Lightning, Joint Test Action Group, test-access-port, Directed Automated Random Testing, universal asynchronous receiver/transmitters, clock signals, power signals, and other types of standard, non-standard, and proprietary interfaces and combinations thereof that have been developed, are being developed, or will be developed in the future. Other embodiments of the present invention may provide connector receptacles that may be used to provide a reduced set of functions for one or more of these standards. In various embodiments of the present invention, these interconnect paths provided by these connector receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:

a housing having a passage, the passage defining a front opening in the connector receptacle;

a tongue in the passage of the housing;

a plurality of contacts having contacting portions located on the tongue; and a locking mechanism comprising:

a switch having a locked position and an unlocked position;

a cam supporting a friction wheel, the friction wheel to engage a connector insert; and a cam lock wherein, when the switch is in the locked position, the switch engages the cam lock with the friction wheel, and the cam and the friction wheel rotate in a first direction when the connector insert is inserted into the connector receptacle, and the cam lock hinders the cam and the friction wheel from rotating in a second direction, the second direction opposite the first direction, and when the switch is in the unlocked position, the switch disengages the cam lock from the friction wheel, and the cam and friction wheel rotate in the first direction when the connector insert is inserted into the connector receptacle and the cam and the friction wheel rotate in the second direction when the connector insert is extracted from the connector receptacle.

2. The connector receptacle of claim 1 wherein the cam lock is lifted away from the cam when the switch is in the unlocked position.

3. The connector receptacle of claim 2 further comprising a spring to apply a force by the cam lock against the cam when the switch is in the locked position.

4. The connector receptacle of claim 3 further comprising a second friction wheel concentrically located around the cam.

5. The connector receptacle of claim 4 wherein the friction wheel is formed of silicone rubber and the cam is formed of stainless steel.

6. The connector receptacle of claim 4 wherein the switch is a sliding switch that is user actuated.

7. The connector receptacle of claim 1 wherein the connector receptacle is a Universal Serial Bus Type-C connector receptacle.

8. A connector receptacle comprising:

a housing having a passage, the passage defining a front opening in the connector receptacle;

a tongue in the passage of the housing;

a plurality of contacts having contacting portions located on the tongue; and a locking mechanism comprising:

a switch having a locked position and an unlocked position;

a gear supporting a first friction wheel, the first friction wheel to engage a connector insert, the gear having a plurality of ratchet teeth; and a gear lock having a tooth to engage the ratchet teeth on the gear such that, when the switch is in the locked position, the gear lock allows the gear to rotate in a first direction when the connector insert is inserted into the connector receptacle, and the gear lock hinders the gear from rotating in a second direction, the second direction opposite the first direction, and when the switch is in the unlocked position, the gear lock is disengaged from the gear and the gear rotates in the first direction when the connector insert is inserted into the connector receptacle and in the second direction when the connector insert is extracted from the connector receptacle.

9. The connector receptacle of claim 8 wherein the gear lock is lifted away from the gear when the switch is in the unlocked position.

10. The connector receptacle of claim 9 further comprising a spring to apply a force by the gear lock against the gear when the switch is in the locked position.

11. The connector receptacle of claim 10 further comprising a second friction wheel concentrically located around the gear.

12. The connector receptacle of claim 11 wherein the switch is a sliding switch that is user actuated.

13. The connector receptacle of claim 8 wherein the connector receptacle is a Universal Serial Bus Type-C connector receptacle.

14. A connector receptacle comprising:

a housing having a passage, the passage defining a front opening in the connector receptacle;

a tongue in the passage of the housing;

a plurality of contacts having contacting portions located on the tongue;

a first friction mechanism; and a second friction mechanism separate from the first friction mechanism, wherein each of the first friction mechanism and second friction mechanism comprises a high-friction surface at least partially around an axle, the axle having a central axis, the high-friction surface to provide a friction force against an outside surface of a connector insert, wherein when the connector insert is inserted into the connector receptacle, the connector insert applies a rotational force in a direction to the friction mechanism such that the friction mechanism rotates in the direction about the central axis, and when the connector insert is extracted from the connector receptacle, the connector insert applies a rotational force in an opposite direction to the friction mechanism such that the friction mechanism rotates in the opposite direction about the central axis, wherein when the connector insert is inserted into the connector receptacle, the first friction mechanism and the second friction mechanism provide a first resistance to the insertion of the connector insert, and wherein when the connector insert is extracted from the connector receptacle, a binding force is generated that provides a second resistance to the extraction of the connector insert from the connector receptacle, the second resistance higher than the first resistance.

15. The connector receptacle of claim 14 wherein each of the first friction mechanism and the second friction mechanism comprises a friction wheel.

16. A connector receptacle comprising:

a housing having a passage, the passage defining a front opening in the connector receptacle;

a tongue in the passage of the housing;

a plurality of contacts having contacting portions located on the tongue;

a friction mechanism comprising a high-friction surface at least partially around an axle, the axle having a central axis, the high-friction surface to provide a friction force against an outside surface of a connector insert, wherein when the connector insert is inserted into the connector receptacle, the connector insert applies a rotational force in a first direction to the friction mechanism such that the friction mechanism rotates in the first direction about the central axis and the friction mechanism provides a first resistance to the insertion of the connector insert into the connector receptacle, and when the connector insert is extracted from the connector receptacle, the connector insert applies a rotational force in a second direction to the friction mechanism such that the friction mechanism rotates in the second direction about the central axis, thereby generating a binding force that provides a second resistance to the extraction of the connector insert from the connector receptacle, the second resistance higher than the first resistance; and a locking mechanism comprising:

a switch having a locked position and an unlocked position; and a lock to engage the axle such that, when the switch is in the locked position, the lock allows the friction mechanism to rotate in the first direction when the connector insert is inserted into the connector receptacle, and the lock generates the binding force and hinders the friction mechanism from rotating in the second direction, the second direction opposite the first direction, and when the switch is in the unlocked position, the lock is disengaged from the axle and the friction mechanism rotates in the first direction when the connector insert is inserted into the connector receptacle and in the second direction when the connector insert is extracted from the connector receptacle.

17. The connector receptacle of claim 16 wherein the axle further comprises a gear having a plurality of ratchet teeth and the lock comprises a tooth to engage the ratchet teeth on the gear.

18. The connector receptacle of claim 17 wherein the lock is lifted away from the axle when the switch is in the unlocked position.

19. The connector receptacle of claim 18 wherein the connector receptacle is a Universal Serial Bus Type-C connector receptacle.

* * * * *